US011397011B2

(12) United States Patent
Tadokoro et al.

(10) Patent No.: US 11,397,011 B2
(45) Date of Patent: Jul. 26, 2022

(54) AIR-SENDING DEVICE AND REFRIGERATION CYCLE APPARATUS

(71) Applicant: Mitsubishi Electric Corporation, Tokyo (JP)

(72) Inventors: Takahide Tadokoro, Tokyo (JP); Yasuaki Kato, Tokyo (JP); Keisuke Hokazono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/047,098

(22) PCT Filed: Jun. 4, 2018

(86) PCT No.: PCT/JP2018/021367
§ 371 (c)(1),
(2) Date: Oct. 13, 2020

(87) PCT Pub. No.: WO2019/234793
PCT Pub. Date: Dec. 12, 2019

(65) Prior Publication Data

US 2021/0164670 A1 Jun. 3, 2021

(51) Int. Cl.
*F24F 1/38* (2011.01)
*F04D 29/38* (2006.01)
(Continued)

(52) U.S. Cl.
CPC ..... *F24F 1/38* (2013.01); *F04D 29/38* (2013.01); *F04D 29/44* (2013.01); *F04D 29/542* (2013.01);
(Continued)

(58) Field of Classification Search
CPC ..... F04D 29/703; F04D 19/002; F04D 25/08; F05D 2260/96; F24F 1/38; F24F 1/56
See application file for complete search history.

(56) References Cited

U.S. PATENT DOCUMENTS

2005/0063822 A1* 3/2005 Horng ..... F04D 29/582 415/211.2
2005/0238481 A1* 10/2005 Yamamoto ..... F24F 1/38 415/121.2
(Continued)

FOREIGN PATENT DOCUMENTS

EP 0 905 455 A1 3/1999
JP H05-071766 A 3/1993
(Continued)

OTHER PUBLICATIONS

Extended European Search Report dated Apr. 23, 2021 issued in corresponding European patent application No. 18921380.4.
(Continued)

*Primary Examiner* — Brian P Wolcott
*Assistant Examiner* — Jackson N Gillenwaters
(74) *Attorney, Agent, or Firm* — Posz Law Group, PLC

(57) ABSTRACT

An air-sending device includes a propeller fan, a bell mouth surrounding an outer periphery of the propeller fan, a fan grille disposed downstream of the bell mouth and including a plurality of first crosspieces. An edge of the air outlet of the bell mouth includes a varying portion whose distance from a rotation axis of the propeller fan varies. In a cross-section of any of the plurality of first crosspieces that is perpendicular to a longitudinal direction of the any of the plurality of first crosspieces, a virtual line segment connecting an upstream side end portion and a downstream side end portion is defined as a first virtual line segment. At the portions of the plurality of first crosspieces disposed on the inner circumference side of the varying portion, the angle between a virtual line segment parallel to the rotation axis and the first virtual line segment is changed.

6 Claims, 23 Drawing Sheets

(51) Int. Cl.

| | |
|---|---|
| ***F04D 29/44*** | (2006.01) |
| ***F04D 29/54*** | (2006.01) |
| ***F24F 1/56*** | (2011.01) |
| ***F24F 1/40*** | (2011.01) |

(52) U.S. Cl.
CPC ..... *F24F 1/56* (2013.01); *F05D 2240/20* (2013.01); *F05D 2260/96* (2013.01); *F24F 1/40* (2013.01)

(56) References Cited

U.S. PATENT DOCUMENTS

| | | | | |
|---|---|---|---|---|
| 2014/0299298 | A1* | 10/2014 | Kono | F24F 1/46 165/121 |
| 2016/0146217 | A1* | 5/2016 | Tadokoro | F04D 29/522 415/121.2 |
| 2017/0343224 | A1 | 11/2017 | Kasugai et al. | |
| 2018/0156240 | A1* | 6/2018 | Muller | F04D 29/44 |

FOREIGN PATENT DOCUMENTS

| | | | |
|---|---|---|---|
| JP | 2007-163036 | A | 6/2007 |
| JP | 2010-117044 | A | 5/2010 |

OTHER PUBLICATIONS

International Search Report of the International Searching Authority dated Aug. 28, 2018 for the corresponding international application No. PCT/JP2018/021367 (and English translation).

* cited by examiner

AIR-SENDING DEVICE AND REFRIGERATION CYCLE APPARATUS

TECHNICAL FIELD

The present disclosure relates to an air-sending device including a fan grille, and a refrigeration cycle apparatus including the air-sending device.

BACKGROUND ART

There has been proposed an air-sending device including a propeller fan and a bell mouth, as an air-sending device to be mounted on a refrigeration cycle apparatus or other apparatuses. The bell mouth is a component that surrounds the outer periphery of the propeller fan to form an air passage. Some air-sending devices including a propeller fan and a bell mouth further includes a fan grille disposed downstream of an air outlet of the bell mouth in the direction of airflow generated by the propeller fan. The fan grille is a component that covers the propeller fan and the air outlet of the bell mouth to prevent human fingers from coming into contact with the propeller fan, while allowing ventilation.

The noise and energy loss that occur when driving the air-sending device are caused by the ventilation resistance and disturbance of airflow in the air-sending device. Here, as described above, the fan grille is a component that prevents human fingers from coming into contact with the propeller fan. Accordingly, the fan grille includes a plurality of crosspieces arranged at intervals that prevent human fingers from being inserted therebetween. Therefore, the fan grille is likely to increase the ventilation resistance and disturbance of airflow.

To solve this problem, there has been proposed an air-sending device including a propeller fan, a bell mouth, and a fan grille, wherein the fan grille has a shape that reduces the ventilation resistance and disturbance of airflow. For example, a fan grille of an air-sending device disclosed in Patent Literature 1 includes a plurality of horizontal crosspieces. Each of the horizontal crosspieces has a shape in which a dimension in the direction from its upstream side end portion to its downstream side end portion is larger than a dimension in the direction perpendicular to that direction, in a cross-section perpendicular to the longitudinal direction of the horizontal crosspiece. That is, each of the horizontal crosspieces has an elongated shape in the direction from its upstream side end portion to its downstream side end portion, in the cross-section perpendicular to the longitudinal direction of the horizontal crosspiece. Further, each of the horizontal crosspieces is twisted such that one longitudinal end and the other longitudinal end thereof are inclined in opposite directions. The horizontal crosspieces are twisted at the same angle. The airflow blown out from the propeller fan is a swirling flow. Therefore, according to Patent Literature 1, by configuring each horizontal crosspiece as in Patent Literature 1, the direction from the upstream side end portion to the downstream side end portion can be aligned with the direction of airflow blown out from the propeller fan. That is, according to Patent Literature 1, by configuring each horizontal crosspiece as in Patent Literature 1, it is possible to reduce the ventilation resistance and disturbance of airflow, and to reduce noise and energy loss that occur when driving the air-sending device.

CITATION LIST

Patent Literature

Patent Literature 1: Japanese Unexamined Patent Application Publication No. 2007-163036

SUMMARY OF INVENTION

Technical Problem

The direction of airflow blown out from a propeller fan, that is, the degree of inclination of a swirling flow with respect to the rotation axis of a propeller fan is affected not only by the blade shape of the propeller fan but also by the shape of a bell mouth. For example, if an air outlet of a bell mouth is circular, that is, if an air outlet of a bell mouth is axially symmetric with respect to the rotation axis of a propeller fan, the degree of inclination of a swirling flow with respect to the rotation axis of the propeller fan is constant. In other words, if the distance between the edge of the air outlet of the bell mouth and the rotation axis of the propeller fan is constant, the degree of inclination of the swirling flow with respect to the rotation axis of the propeller fan is constant. The propeller fan disclosed in Patent Literature 1 is designed on the premise that the air outlet of the bell mouth is circular. Therefore, in the case where the air outlet of the bell mouth is circular, if each horizontal crosspiece is configured as in Patent Literature 1, the direction from the upstream side end portion to the downstream side end portion can be aligned with the direction of airflow blown out from the propeller fan. That is, in the case where the air outlet of the bell mouth is circular, if each horizontal crosspiece is configured as in Patent Literature 1, it is possible to reduce the ventilation resistance and disturbance of airflow, and to reduce noise and energy loss that occur when driving the air-sending device.

In recent years, there have been cases where, to reduce the size of a casing in which an air-sending device is mounted, a part of the edge of an air outlet of a bell mouth is displaced toward the rotation axis of a propeller fan. That is, an air outlet of a bell mouth is often axially asymmetric with respect to the rotation axis of a propeller fan. In this case, the distance between the edge of the air outlet of the bell mouth and the rotation axis of the propeller fan varies with the position. Accordingly, the degree of inclination of a swirling flow with respect to the rotation axis of the propeller fan varies with the position, at the air outlet of the bell mouth. Specifically, when viewed in the rotation direction of the propeller fan, in the range where the distance between the edge of the air outlet of the bell mouth and the rotation axis of the propeller fan decreases, the airflow blown out of the propeller fan is accelerated, so that the inclination of the swirling flow with respect to the rotation axis of the propeller fan is reduced. On the other hand, when viewed in the rotation direction of the propeller fan, in the range where the distance between the edge of the air outlet of the bell mouth and the rotation axis of the propeller fan increases, the airflow blown out of the propeller fan is decelerated, so that the inclination of the swirling flow with respect to the rotation axis of the propeller fan is increased.

In this manner, in the case where an air outlet of a bell mouth is axially asymmetric with respect to the rotation axis of a propeller fan, the inclination of a swirling flow with respect to the rotation axis of the propeller fan varies with the position, at the air outlet of the bell mouth. Accordingly, in the case of an air-sending device in which an air outlet of a bell mouth is axially asymmetric with respect to the rotation axis of a propeller fan, even if the configuration of the horizontal crosspieces of Patent Literature 1 is adopted to a fan grille; the direction from the upstream side end portion to the downstream side end portion is not aligned with the direction of airflow blown out from the propeller fan. As a result; it is not possible to reduce noise and energy loss that occur when driving the air-sending device.

The present disclosure has been made to solve the above problem. A first object of the present disclosure is to provide an air-sending device in which an air outlet of a bell mouth is axially asymmetric with respect to the rotation axis of a propeller fan, the air-sending device including a fan grille that makes it possible to reduce noise and energy loss that occur when driving the air-sending device as compared to the related art. A second object of the present disclosure is to provide a refrigeration cycle apparatus including the air-sending device.

Solution to Problem

An air-sending device according to an embodiment of the present disclosure includes: a propeller fan configured to rotate about a rotation axis; a bell mouth having an air outlet and surrounding an outer periphery of the propeller fan; and a fan grille disposed downstream of the air outlet in a direction of airflow generated by the propeller fan; the fan grille including a plurality of first crosspieces; each of the plurality of first crosspieces having an upstream side end portion and a downstream side end portion, the upstream side end portion being positioned on an upstream side of the airflow; the downstream side end portion being positioned on a downstream side of the airflow, wherein the air-sending device is configured such that where in a cross-section of any of the plurality of first crosspieces, the cross-section being perpendicular to a longitudinal direction of the any of the plurality of first crosspieces, a virtual line segment connecting the upstream side end portion and the downstream side end portion is a first virtual line segment, an acute angle of angles formed by the first virtual line segment and a virtual line segment extending in parallel to the rotation axis, the acute angle being formed on a side of the downstream side end portion, is an inclination angle, and on a virtual plane that is orthogonal to the rotation axis and on which the rotation axis, the air outlet and the plurality of first crosspieces are projected, a position of the rotation axis on the virtual plane is a center point, a virtual line segment connecting between the center point and any one point of an edge of the air outlet is a second virtual line segment, a length of the second virtual line segment is a radial distance, a first point is a point on the edge of the air outlet, from which the radial distance decreases when the second virtual line segment rotates about the center point in a rotation direction of the propeller fan, a second point is a point on the edge of the air outlet, from which the radial distance increases when the second virtual line segment rotates about the center point in the rotation direction past the first point, a third point is a point on the edge of the air outlet, from which the radial distance no longer increases when the second virtual line segment rotates about the center point in the rotation direction past the second point, a fourth point is a point on the edge of the air outlet, a point located before the second point and after the first point in the rotation direction, being a midpoint between the first point and the second point, a fifth point is a point on the edge of the air outlet, a point located before the third point and after the second point in the rotation direction, being a midpoint between the second point and the third point, a sixth point is a point on the edge of the air outlet, located before the fourth point and after the first point in the rotation direction, and the radial distance between the center point and the sixth point is a first radial distance, a seventh point is a point on the edge of the air outlet, located before the third point and after the fifth point in the rotation direction, and the radial distance between the center point and the seventh point is the first radial distance, a virtual line segment connecting between the center point and the sixth point is a third virtual line segment, a virtual line segment connecting between the center point and the seventh point is a fourth virtual line segment, an eighth point is a point of intersection of a virtual circle having a center being the center point and the third virtual line segment of the plurality of first crosspieces, a ninth point is a point of intersection of the virtual circle and the fourth virtual line segment of the plurality of first crosspieces, the cross-section at the eighth point and the ninth point has a shape in which a dimension in a first direction from the upstream side end portion to the downstream side end portion is larger than a dimension in a second direction perpendicular to the first direction of the cross-section of the first crosspiece, and the inclination angle at the eighth point is smaller than the inclination angle at the ninth point.

A refrigeration cycle apparatus according to another embodiment of the present disclosure includes the air-sending device according to the above embodiment of the present disclosure, and a heat exchanger configured to exchange heat between refrigerant flowing inside and air supplied by the air-sending device.

Advantageous Effects of Invention

An air-sending device according to an embodiment of the present disclosure is configured such that an air outlet of a bell mouth is axially asymmetric round the rotation axis of a propeller fan, and such that even when the inclination of a swirling flow varies, the direction from an upstream side end portion to a downstream side end portion can be aligned with the direction of airflow blown out from the propeller fan, as compared to the related art. Accordingly, the air-sending device according to the above embodiment of the present disclosure is an air-sending device in which the air outlet of the bell mouth is axially asymmetric with respect to the rotation axis of the propeller fan, and it is possible to reduce noise and energy loss that occur when driving the air-sending device as compare to the related art.

DESCRIPTION OF EMBODIMENTS

Embodiment 1

Figure 1:
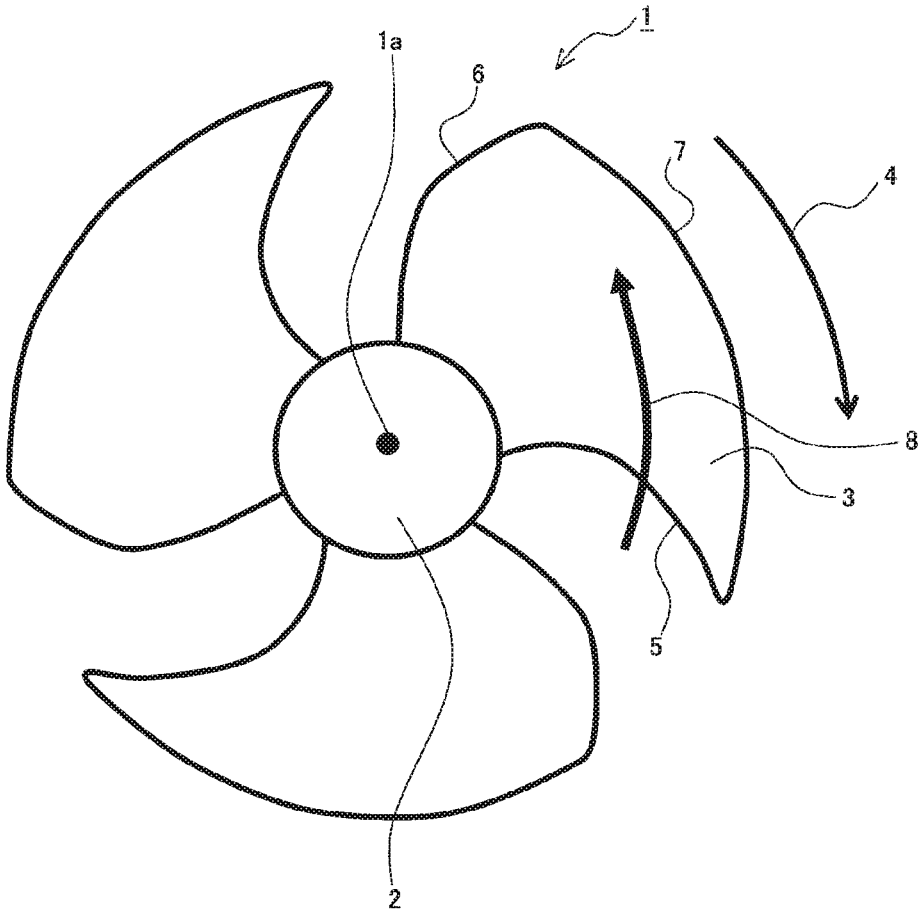
FIG. 1 illustrates a propeller fan of an air-sending device according to Embodiment 1 of the present disclosure.

FIG. 1 illustrates a propeller fan of an air-sending device according to Embodiment 1 of the present disclosure. Note that FIG. 1 illustrates a propeller fan 1 as viewed from the pressure surface side of blades 3 in the direction of a rotation axis 1*a* of the propeller fan 1. The pressure surface of each blade 3 is the surface of one of the sides of the blade 3 that pushes out air.

The propeller fan 1 rotates about the rotation axis 1*a*. Specifically, as indicated by the thin arc-shaped arrow in FIG. 1, the propeller fan 1 rotates about the rotation axis 1*a* in a rotation direction 4. The propeller fan 1 includes a boss 2 that rotates about the rotation axis 1*a*. The propeller fan 1 also includes the plurality of blades 3 on the outer periphery of the boss 2, That is, the plurality of blades 3 rotate about the rotation axis 1*a*, together with the boss 2.

Each blade 3 includes, as edges, a leading edge 5, a trailing edge 6, and an outer peripheral edge 7. The leading edge 5 is an edge on the front side in the rotation direction of the blade 3. The trailing edge 6 is an edge on the rear side in the rotation direction of the blade 3. The outer peripheral edge 7 is a portion defining the outer peripheral edge in the radial direction of the blade 3. When the propeller fan 1 is rotated by a driving source (not illustrated) such as a motor in the rotation direction 4, air flows on the surface of each blade 3 as indicated by airflow 8.

Figure 2:
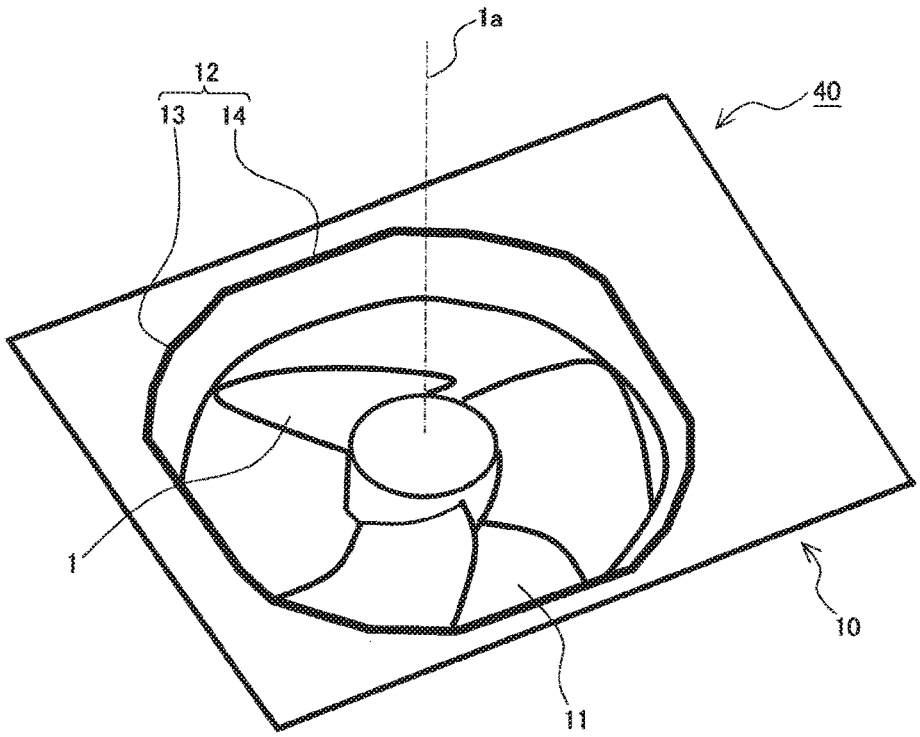
FIG. 2 is a perspective view of the air-sending device, with a fan grille removed, according to Embodiment 1 of the present disclosure.

FIG. 2 is a perspective view of the air-sending device, with a fan grille removed, according to Embodiment 1 of the present disclosure. Note that FIG. 2 illustrates an air-sending device 40, with a fan grille 20 removed, as viewed from an air outlet 11 side of a bell mouth 10.

The air-sending device 40 according to Embodiment 1 includes the bell mouth 10. The bell mouth 10 has the air outlet 11, and surrounds the outer periphery of the propeller fan 1. That is, the bell mouth 10 is a component that forms an air passage.

In general, the edge of an air outlet of a bell mouth is circular about the rotation axis of a propeller fan. That is, in general, the edge of an air outlet of a bell mouth is axially symmetric with respect to the rotation axis of a propeller fan. Meanwhile, an edge 12 of the air outlet 11 of the bell mouth 10 according to Embodiment 1 is axially asymmetric with respect to the rotation axis 1*a* of the propeller fan 1. Specifically, the edge 12 of the air outlet 11 of the bell mouth 10 includes constant portions 13 and varying portions 14. Each constant portion 13 is a portion of the edge 12 whose distance from the rotation axis 1*a* is constant. The constant portion 13 has the shape of a circular arc about the rotation axis 1*a* when the constant portion 13 is viewed in the direction of the rotation axis 1*a*. Each varying portion 14 is a portion of the edge 12 whose distance from the rotation axis 1*a* varies. In Embodiment 1, the varying portion 14 has a linear shape when the varying portion 14 is viewed in the direction of the rotation axis 1*a*.

Figure 3:
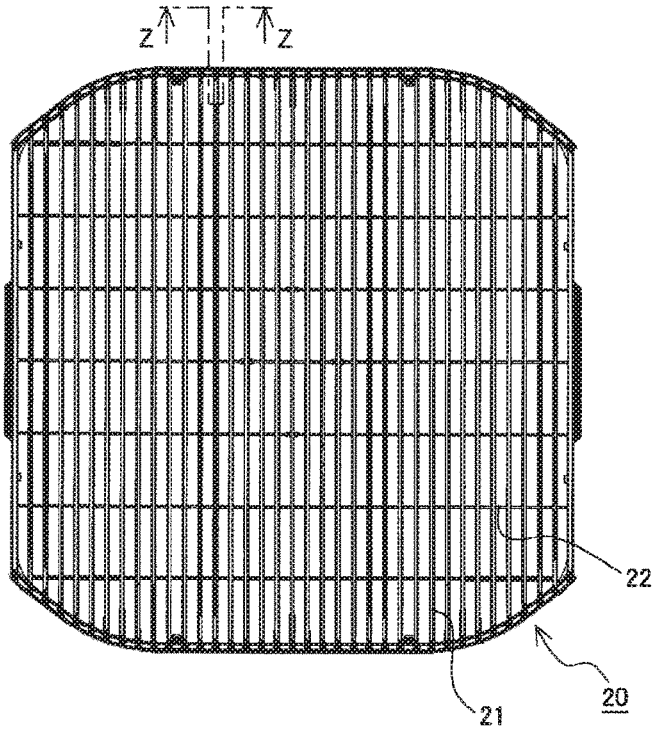
FIG. 3 is a front view of the fan grille according to Embodiment 1 of the present disclosure.
Figure 4:
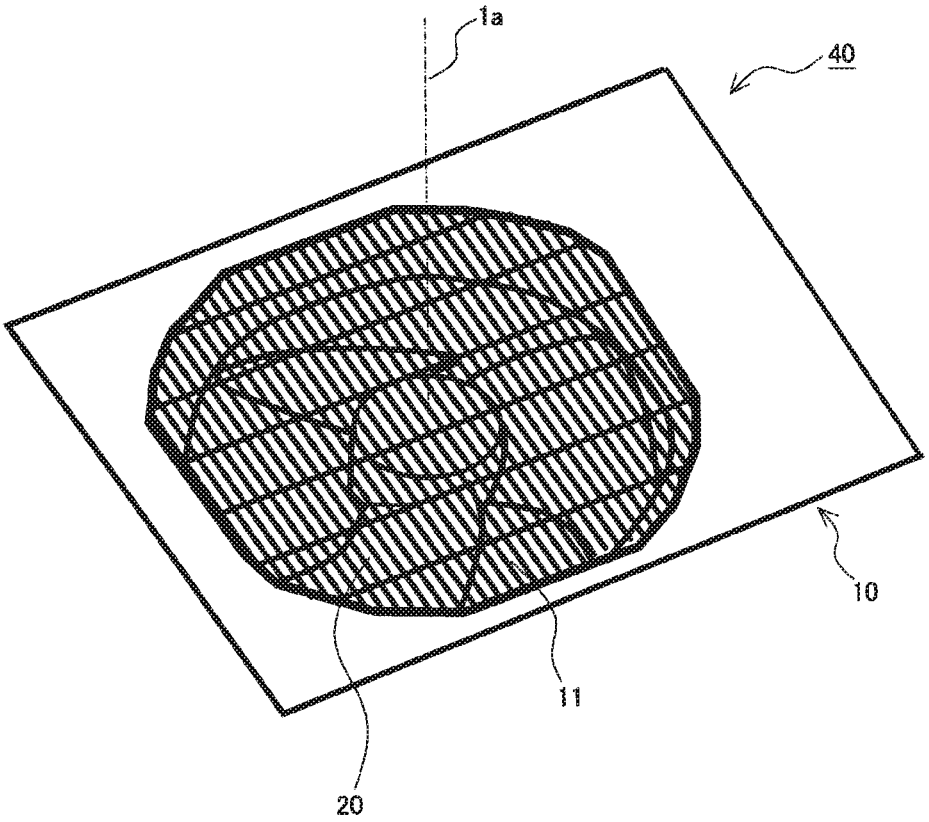
FIG. 4 is a perspective view of the air-sending device, with the fan grille attached, according to Embodiment 1 of the present disclosure.
Figure 5:
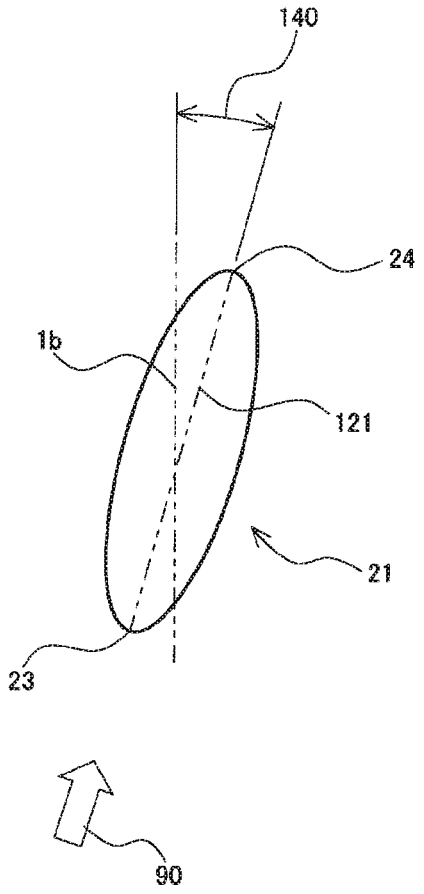
FIG. 5 is a cross-sectional view of a first crosspiece of the fan grille according to Embodiment 1 of the present disclosure, illustrating a cross-section of any first crosspiece perpendicular to a longitudinal direction of the first crosspiece.

FIG. 3 is a front view of the fan grille according to Embodiment 1 of the present disclosure. FIG. 4 is a perspective view of the air-sending device, with the fan grille attached, according to Embodiment 1 of the present disclosure. FIG. 5 is a cross-sectional view of a first crosspiece of the fan grille according to Embodiment 1 of the present disclosure, illustrating a cross-section of any first crosspiece perpendicular to a longitudinal direction of the first crosspiece. Note that FIG. 4 illustrates the air-sending device 40, with the fan grille 20 attached, as viewed from the air outlet 11 side of the bell mouth 10. FIG. 5 is, for example, a cross-sectional view of a first crosspiece 21 in the Z-Z cross-section of FIG. 3. The white arrow illustrated in FIG. 5 indicates the direction of airflow 90 blown out from the propeller fan 1, in the cross-section illustrated in FIG. 5.

The air-sending device 40 according to Embodiment 1 includes the fan grille 20 that covers the propeller fan 1 and the air outlet 11 of the bell mouth 10 to prevent human fingers from coming into contact with the propeller fan 1, while allowing ventilation. The fan grille 20 is disposed downstream of the air outlet 11 of the bell mouth 10 in the direction of airflow generated by the propeller fan 1. The fan grille 20 includes the plurality of first crosspieces 21. The plurality of first crosspieces 21 are arranged at such intervals that prevent human fingers from being inserted between the adjacent first crosspieces 21. That is, the fan grille 20 covers the propeller fan 1 and the air outlet 11 of the bell mouth 10, with the plurality of first crosspieces 21, while allowing ventilation. In FIG. 3, the first crosspieces 21 each extending in the vertical direction in the drawing are arranged at predetermined intervals in the lateral direction in the drawing.

The fan grille 20 includes a plurality of second crosspieces 22 each intersecting the first crosspieces 21. In FIG. 3, the second crosspieces 22 each extending in the lateral direction in the drawing are arranged at predetermined intervals in the vertical direction in the drawing. That is, the plurality of first crosspieces 21 and the plurality of second crosspieces 22 are arranged in a mesh form. Each of the plurality of second crosspieces 22 supports the first crosspieces 21 to secure the strength of the first crosspieces 21. In Embodiment 1, to reduce the ventilation resistance of the fan grille 20, the number of the second crosspieces 22 is less than the number of first crosspieces 21.

As illustrated in FIG. 5, each of the first crosspieces 21 has an elongated shape, such as an ellipse, in a cross-section perpendicular to the longitudinal direction of the first crosspiece 21. Specifically, each of the first crosspieces 21 has an upstream side end portion 23 positioned on an upstream side and a downstream side end portion 24 positioned on a downstream side, in the direction of airflow generated by the propeller fan 1. Further, each of the first crosspieces 21 has a shape in which a dimension in a first direction from the upstream side end portion 23 to the downstream side end portion 24 is larger than a dimension in a second direction perpendicular to the first direction, in the cross-section perpendicular to the longitudinal direction of the first crosspiece 21.

Further, in the cross-section perpendicular to the longitudinal direction of the first crosspiece 21, at least a part of the first crosspiece 21 is configured such that the longitudinal direction as the first direction is inclined with respect to the rotation axis 1*a* of the propeller fan 1. Specifically, as illustrated in FIG. 5, in the cross-section perpendicular to the longitudinal direction of the first crosspiece 21, a first virtual line segment 121 is a virtual line segment connecting between the upstream side end portion 23 and the downstream side end portion 24. In FIG. 5, a virtual line segment 1*b* parallel to the rotation axis 1*a* of the propeller fan 1 is illustrated. As illustrated in FIG. 5, in the cross-section perpendicular to the longitudinal direction of the first crosspiece 21, an inclination angle 140 is an acute angle that is one of angles formed by the first virtual line segment 121 and the virtual line segment 1*b* and that is formed on the downstream side end portion 24 side. In this case, the inclination angle 140 is larger than 0 degrees. That is, the first virtual line segment 121 is inclined with respect to the virtual line segment 1*b*. More specifically, in the cross-section perpendicular to the longitudinal direction of the first crosspiece 21, the first virtual line segment 121 is inclined with respect to the virtual line segment 1*b* such that the first direction from the upstream side end portion 23 to the downstream side end portion 24 is directed toward the rotation direction of the propeller fan 1 at a position in the cross-section.

The airflow blown out from the propeller fan 1 is a swirling flow. That is, the direction of airflow blown out from the propeller fan 1 is inclined with respect to the rotation axis 1*a* of the propeller fan 1. Therefore, when the first virtual line segment 121 is inclined with respect to the virtual line segment 1*b* as described above, the airflow blown out from the propeller fan 1 easily flows along the first crosspieces 21. If the airflow blown out from the propeller fan 1 can flow along the first crosspieces 21, it is possible to reduce the ventilation resistance of the fan grille 20. Further, if the airflow blown out from the propeller fan 1 can flow along the first crosspieces 21, it is possible to prevent the airflow blown out from the propeller fan 1 from being directed away from the surface of the first crosspieces 21, and to reduce disturbance of airflow. That is, if the airflow blown out from the propeller fan 1 can flow along the first crosspieces 21, it is possible to reduce noise and energy loss that occur when driving the air-sending device 40.

In the case where the air outlet 11 of the bell mouth 10 is axially symmetric with respect to the rotation axis 1*a* of the propeller fan 1, the degree of inclination of the swirling flow with respect to the rotation axis 1*a* of the propeller fan 1 is constant. Therefore, in the case where the air outlet 11 of the bell mouth 10 is axially symmetric with respect to the rotation axis 1*a* of the propeller fan 1, even if the inclination of the first virtual line segment 121 with respect to the virtual line segment 1*b* is constant at every position on the first crosspieces 21, the airflow blown out from the propeller fan 1 can flow along the first crosspieces 21.

However, as mentioned above, in the air-sending device 40 of Embodiment 1, the air outlet 11 of the bell mouth 10 is axially asymmetric with respect to the rotation axis 1*a* of the propeller fan 1. Therefore, in the air-sending device 40 of Embodiment 1, the inclination of the swirling flow with respect to the rotation axis 1*a* of the propeller fan 1 varies with the position. Accordingly, in the air-sending device 40 of Embodiment 1, if the inclination of the first virtual line segment 121 with respect to the virtual line segment 1*b* is constant at every position on the first crosspieces 21, the airflow blown out from the propeller fan 1 cannot flow along the first crosspieces 21 at some positions. In consideration of this, in the air-sending device 40 of Embodiment 1, the inclination of the first virtual line segment 121 with respect to the virtual line segment 1*b* is changed according to the position.

The following describes in detail how the airflow blown out from the propeller fan 1 flows, in the air-sending device 40 of Embodiment 1. The following also describes in detail how the inclination of the first virtual line segment 121 with respect to the virtual line segment 1*b* is changed according to the position.

Figure 6:
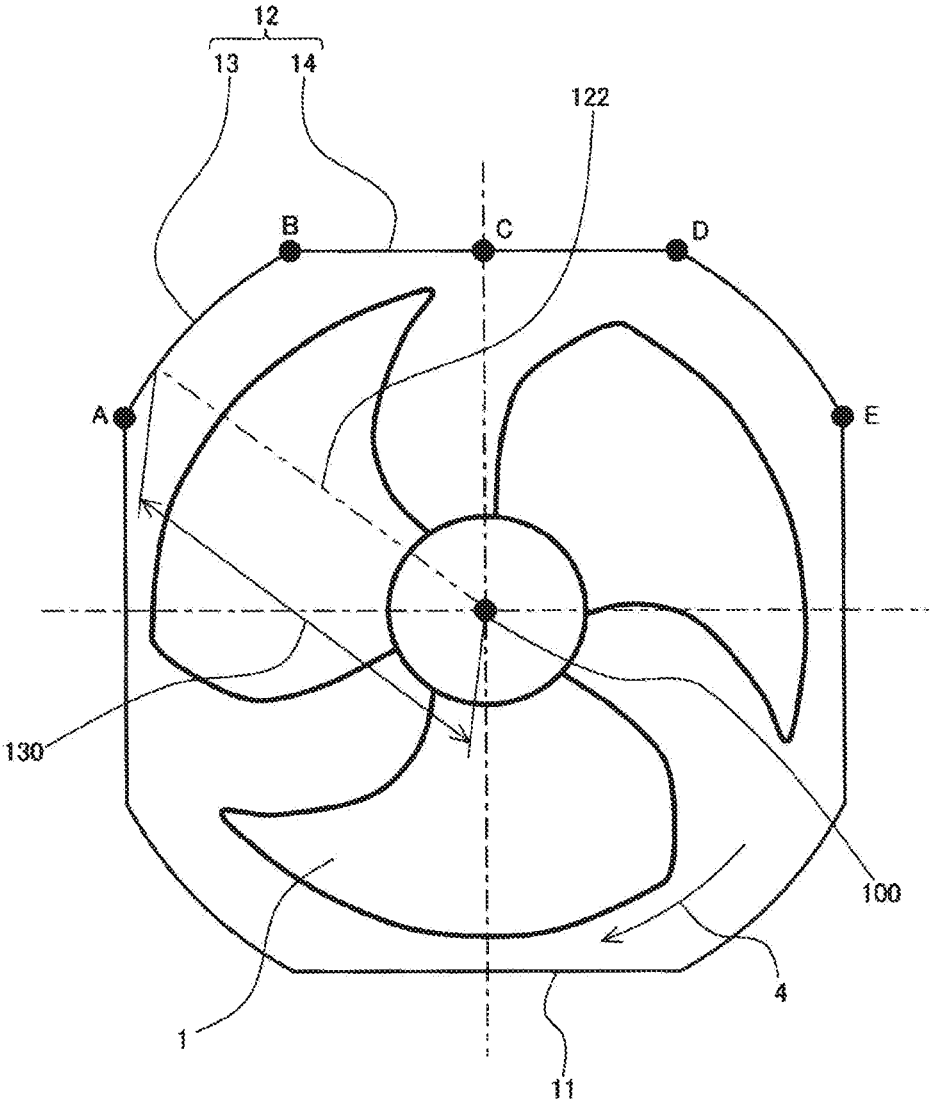
FIG. 6 illustrates the air-sending device according to Embodiment 1 of the present disclosure, wherein a rotation axis and an air outlet of a bell mouth are projected on a virtual plane orthogonal to the rotation axis.
Figure 7:
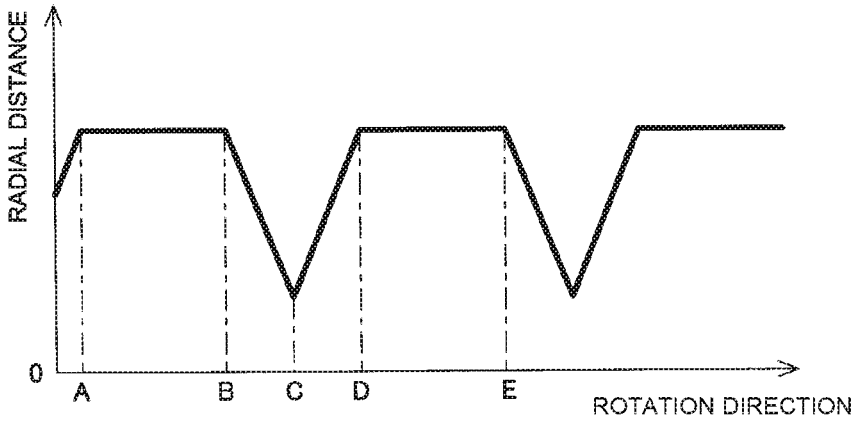
FIG. 7 is a view for explaining the distance between the rotation axis and the air outlet of the bell mouth, in the air-sending device according to Embodiment 1 of the present disclosure.

FIG. 6 illustrates the air-sending device according to Embodiment 1 of the present disclosure, wherein the rotation axis and the air outlet of the bell mouth are projected on a virtual plane orthogonal to the rotation axis. FIG. 7 is a view for explaining the distance between the rotation axis and the air outlet of the bell mouth, in the air-sending device according to Embodiment 1 of the present disclosure.

On the virtual plane illustrated in FIG. 6, a center point 100, a second virtual line segment 122, and a radial distance 130 are defined as follows. The center point 100 is the position of the rotation axis 1*a* of the propeller fan 1. The second virtual line segment 122 is a virtual line segment connecting between the center point 100 and any one point on the edge 12 of the air outlet 11 of the bell mouth 10. The radial distance 130 is the length of the second virtual line segment 122. That is, the radial distance 130 is the distance between the rotation axis 1*a* of the propeller fan 1 and any one point on the edge 12 of the air outlet 11 of the bell mouth 10.

The radial distance 130 varies as illustrated in FIG. 7 as the second virtual line segment 122 rotates about the center point 100 in the rotation direction 4 of the propeller fan 1. In other words, the radial distance 130 varies as illustrated in FIG. 7 when any one point on the edge 12 of the air outlet 11 as an end of the second virtual line segment moves in the rotation direction 4 of the propeller fan 1.

Specifically, the range from a point A to a point B illustrated in FIG. 6 is the range of the constant portion 13 of the edge 12 of the air outlet 11. As described above, the constant portion 13 has the shape of a circular arc about the rotation axis 1*a*. Accordingly, in the range from the point A to the point B, the radial distance 130 is constant without varying. That is, in the range from the point A to the point B, the distance from the rotation axis 1*a* of the propeller fan 1 is constant.

The range from the point B to a point D illustrated in FIG. 6 is the range of the varying portion 14 of the edge 12 of the air outlet 11. As described above, the varying portion 14 has a linear shape when the varying portion 14 is viewed in the direction of the rotation axis 1*a*. Accordingly, when the midpoint between the point B and the point C is defined as a point C, the radial distance 130 decreases in the range from the point B to the point C. That is, in the range from the point B to the point C, the distance from the rotation axis 1*a* of the propeller fan 1 decreases. Meanwhile, in the range from the point C to the point D, the radial distance 130 increases. That is, in the range from the point C to the point D, the distance from the rotation axis 1*a* of the propeller fan 1 increases.

The range from the point D to a point E illustrated in FIG. 6 is the range of the constant portion 13 of the edge 12 of the air outlet 11. Accordingly, in the range from the point D to the point E, the radial distance 130 is constant without varying, as in the range from the point A to the point B. In the subsequent varying portions 14 of the edge 12 of the air outlet 11, the radial distance 130 varies as in the range from the point B to the point D. In the subsequent constant portions 13 of the edge 12 of the air outlet 11, the radial distance 130 is constant as in the range from the point A to the point B.

In the air-sending device 40 according to Embodiment 1, since the edge 12 of the air outlet 11 of the bell mouth 10 has the shape described above, the inclination of the airflow blown out from the propeller fan 1 with respect to the rotation axis 1*a* varies in the manner describe below.

Figure 8:
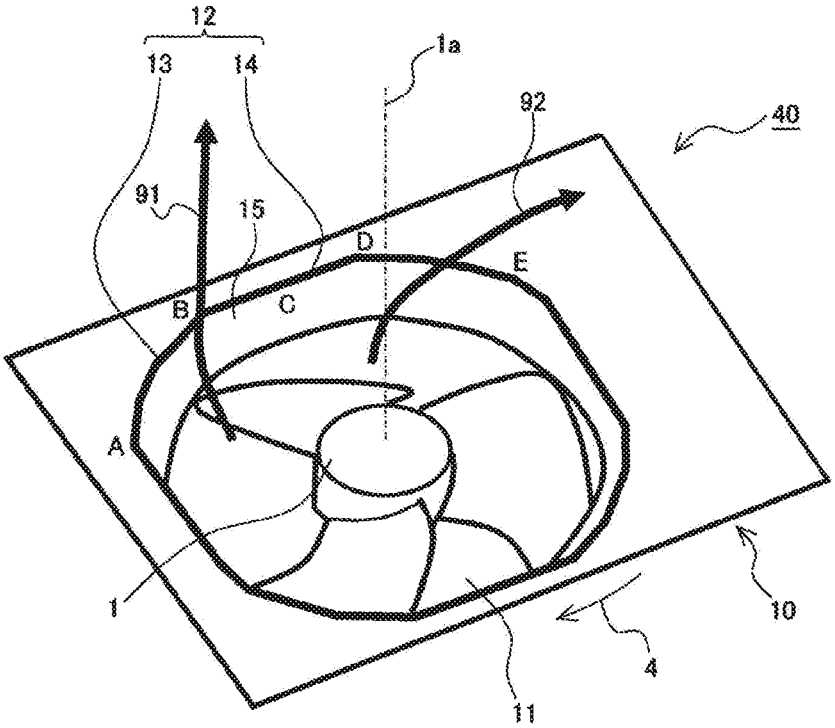
FIG. 8 is a view for explaining the state of a swirling flow of the air-sending device according to Embodiment 1 of the present disclosure.

FIG. 8 is a diagram for explaining the state of a swirling flow of the air-sending device according to Embodiment 1 of the present disclosure. Note that FIG. 8 illustrates the air-sending device 40, with the fan grille 20 removed, as viewed from the air outlet 11 side of the bell mouth 10.

When the propeller fan 1 rotates, the airflow around each blade 3 is introduced from the leading edge 5 side of the blade 3 and is discharged from the trailing edge 6 of the blade 3. The direction of the airflow passing between the blades 3 is changed due to the inclination and camber of each blade 3 when the airflow flows along the blade 3, and a static pressure thereof increases due to a change in momentum. The airflow blown out from the propeller fan 1 is inclined toward the rotation direction 4 and radially outward with respect to the direction of the rotation axis 1*a*, as the blade 3 rotates. That is, the airflow blown out from the propeller fan 1 is a swirling flow.

In the air-sending device 40 of Embodiment 1, the air outlet 11 of the bell mouth 10 is axially asymmetric with respect to the rotation axis 1*a* of the propeller fan 1. Therefore, in the air-sending device 40 of Embodiment 1, the following phenomenon occurs to the airflow blown out from the propeller fan 1.

As described above, in the range from the point B to the point C of the varying portion 14 of the edge 12 of the air outlet 11 of the bell mouth 10, the radial distance 130 decreases. That is, in the range from the point B to the point C, a side wall 15 of the edge 12 of the air outlet 11 becomes closer to the rotation axis 1*a* of the propeller fan 1, toward the rotation direction 4 of the propeller fan 1. Therefore, the blown-out airflow from the propeller fan 1 swirling and spreading radially outward is corrected to the direction of the rotation axis 1*a*, in the range from the point B to the point C on the side wall 15 of the edge 12 of the air outlet 11. Accordingly, as illustrated as airflow 91 in FIG. 8, in the range from the point B to the point C, the component in the direction of the rotation axis 1*a* of the blown-out airflow from the propeller fan 1 becomes greater, so that the inclination of the airflow with respect to the rotation axis 1*a* is reduced.

Meanwhile, as described above, in the range from the point C to the point D of the varying portion 14 of the edge 12 of the air outlet 11 of the bell mouth 10, the radial distance 130 increases. That is, in the range from the point C to the point D, the side wall 15 of the edge 12 of the air outlet 11 becomes farther from the rotation axis 1*a* of the propeller fan 1, toward the rotation direction 4 of the propeller fan 1. This allows the blown-out airflow from the propeller fan 1 swirling and spreading radially outward to easily spread radially outward. Accordingly, as illustrated as airflow 92 in FIG. 8, in the range from the point C to the point D, the inclination of the blown-out airflow from the propeller fan 1 with respect to the rotation axis 1*a* is increased.

In consideration of this, according to the air-sending device 40 of Embodiment 1, the inclination angle 140, which is the inclination of the first virtual line segment 121 with respect to the virtual line segment 1*b*, is changed according to the position as described below.

Figure 9:
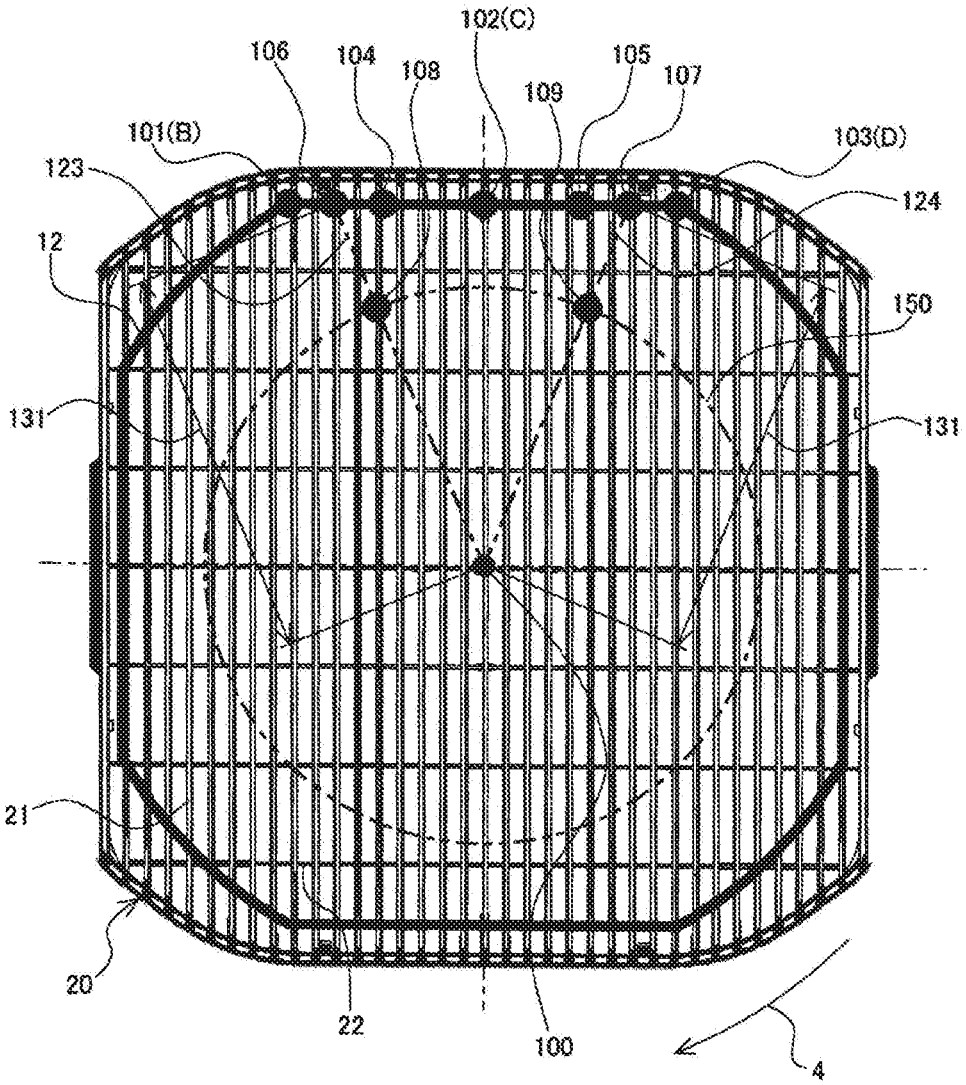
FIG. 9 illustrates the air-sending device according to Embodiment 1 of the present disclosure, wherein the rotation axis, the air outlet of the bell mouth, and a plurality of first crosspieces are projected on a virtual plane orthogonal to the rotation axis.
Figure 10:
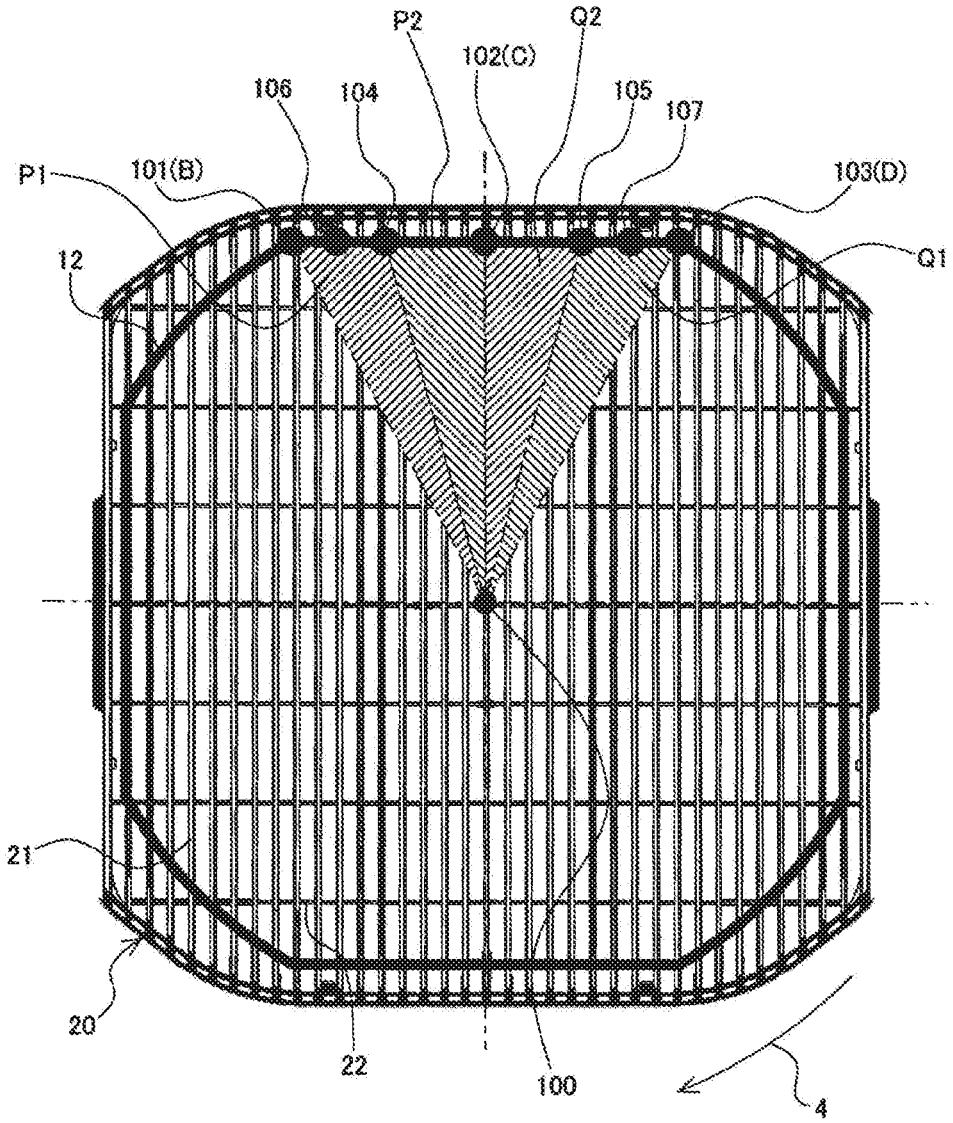
FIG. 10 illustrates the air-sending device according to Embodiment 1 of the present disclosure, wherein the rotation axis, the air outlet of the bell mouth, and the plurality of first crosspieces are projected on a virtual plane orthogonal to the rotation axis.
Figure 11:
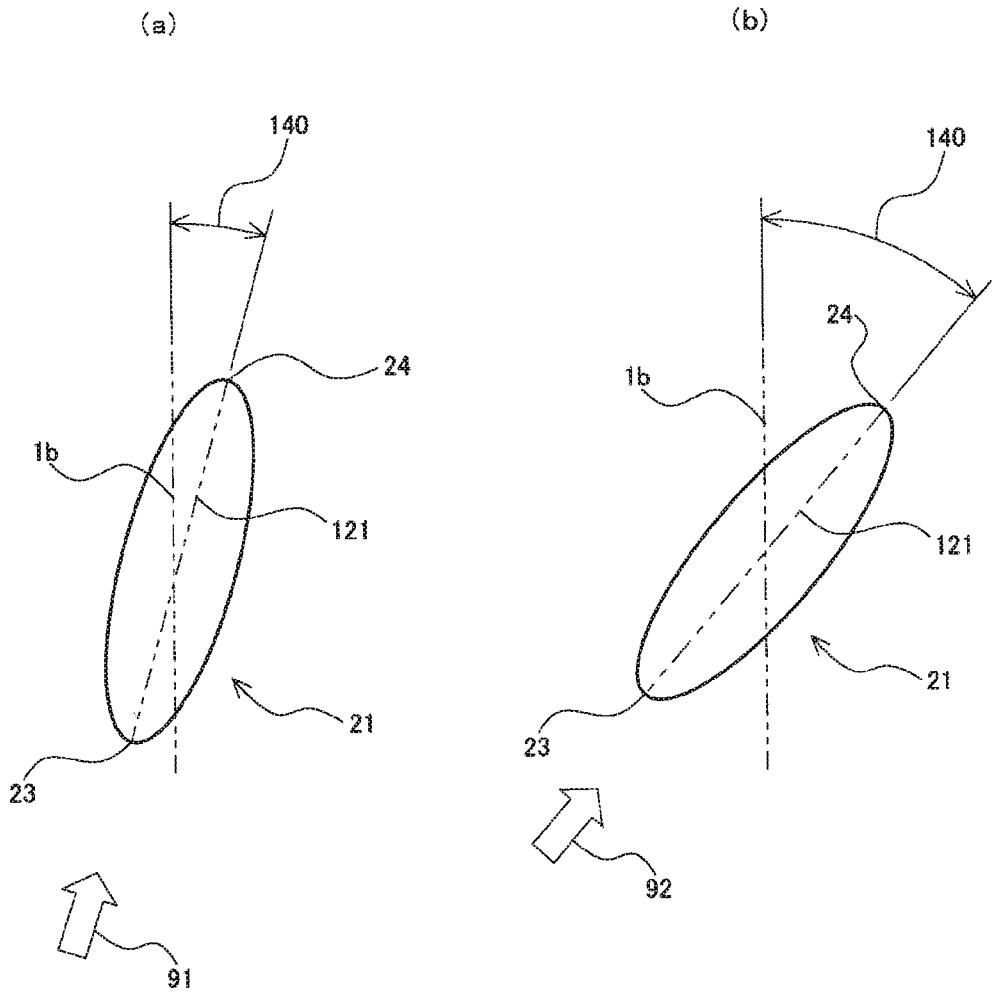
FIG. 11 is a cross-sectional view of the first crosspieces at an eighth point and a ninth point of FIG. 9, illustrating cross-sections of the first crosspieces perpendicular to the longitudinal direction of the first crosspieces at the eighth point and the ninth point.

FIGS. 9 and 10 illustrate the air-sending device according to Embodiment 1 of the present disclosure; wherein the rotation axis; the air outlet of the bell mouth, and the plurality of first crosspieces are projected on a virtual plane orthogonal to the rotation axis. FIG. 11 is a cross-sectional view of the first crosspieces at an eighth point and a ninth point of FIG. 9, illustrating cross-sections of the first crosspieces perpendicular to the longitudinal direction of the first crosspieces at the eighth point and the ninth point. Note that FIG. 11(*a*) is a cross-sectional view of the first crosspiece 21 at the eighth point illustrated in FIG. 9. FIG. 11(*b*) is a cross-sectional view of the first crosspiece 21 at the ninth point illustrated in FIG. 9.

On the virtual plane illustrated in FIG. 9, a first point 101, a second point 102, a third point 103, a fourth point 104, a fifth point 105, a sixth point 106, a first radial distance 131, a seventh point 107, a third virtual line segment 123, a fourth virtual line segment 124, an eighth point 108, and a ninth point 109 are defined as follows.

The first point 101 is a point that is on the edge 12 of the air outlet 11, and from which the radial distance 130 decreases when the second virtual line segment 122 rotates about the center point 100 in the rotation direction 4 of the propeller fan 1. That is, the first point 101 is, for example, the point B of FIG. 6. The second point 102 is a point that is on the edge 12 of the air outlet 11, and from which the radial distance 130 increases when the second virtual line segment 122 rotates about the center point 100 in the rotation direction 4 of the propeller fan 1 past the first point 101. That is, the second point 102 is, for example, the point C of FIG. 6. The third point 103 is a point that is on the edge 12 of the air outlet 11, and from which the radial distance 130 no longer increases when the second virtual line segment 122 rotates about the center point 100 in the rotation direction 4 of the propeller fan 1 past the second point 102, That is, the third point 103 is, for example, the point D of FIG. 6.

The fourth point 104 is a point that is on the edge 12 of the air outlet 11, that is located before the second point 102 and after the first point 101 in the rotation direction 4 of the propeller fan 1, and that is a midpoint between the first point 101 and the second point 102. The fifth point 105 is a point that is on the edge 12 of the air outlet 11, that is located before the third point 103 and after the second point 102 in the rotation direction 4 of the propeller fan 1, and that is a midpoint between the second point 102 and the third point 103. The sixth point 106 is a point that is on the edge 12 of the air outlet 11 and that is located before the fourth point 104 and after the first point 101 in the rotation direction 4 of the propeller fan 1. The first radial distance 131 is the radial distance 130 between the center point 100 and the sixth point 106.

The seventh point 107 is a point that is on the edge 12 of the air outlet 11, and that is located before the third point 103 and after the fifth point 105 in the rotation direction 4 of the propeller fan 1, and the radial distance 130 is the first radial distance 131. The third virtual line segment 123 is a virtual line segment connecting between the center point 100 and the sixth point 106. The fourth virtual line segment 124 is a virtual line segment connecting between the center point 100 and the seventh point 107. The eighth point 108 is a point of intersection of a virtual circle 150 having its center at the center point 100 and having any radius and the third virtual line segment 123, of the plurality of first crosspieces 21. The ninth point 109 is a point of intersection of the virtual circle 150 and the fourth virtual line segment 124, of the plurality of first crosspieces 21.

When the above definitions are applied, the eighth point 108 of the plurality of first crosspieces 21 is any one point on the portions of the plurality of first crosspieces 21 that are present in an area P1 illustrated in FIG. 10. Further, the ninth point 109 of the plurality of first crosspieces 21 is a point on the portions of the plurality of first crosspieces 21 that are present in an area Q1 illustrated in FIG. 10, and satisfies the above definitions. Note that the area P1 is an area defined by a virtual line segment connecting between the center point 100 and the first point 101, a portion between the first point 101 and the fourth point 104 in the varying portion 14 of the edge 12 of the air outlet 11, and a virtual line segment connecting between the center point 100 and the fourth point 104. Further, the area Q1 is an area defined by a virtual line segment connecting between the center point 100 and the fifth point 105, a portion between the fifth point 105 and the third point 103 in the varying portion 14 of the edge 12 of the air outlet 11, and a virtual line segment connecting between the center point 100 and the third point 103.

The area P1 has only to include at least the range of the area P1 illustrated in FIG. 10. Accordingly, the area P1 may include an area located before the area P1 illustrated in FIG. 10 in the rotation direction 4 of the propeller fan 1. For example, in FIG. 10, a midpoint between the point A and the point B illustrated in FIG. 6 on the edge 12 of the air outlet 11 is connected to the center point 100 by a virtual line segment. Then, the area P1 may be the area between this virtual line segment and a virtual line segment connecting between the center point 100 and the fourth point 104. Similarly, the area Q1 has only to include at least the range of the area Q1 illustrated in FIG. 10. Accordingly, the area Q1 may include an area located after the area Q1 illustrated in FIG. 10 in the rotation direction 4 of the propeller fan 1. For example, in FIG. 10, a midpoint between the point D and the point E illustrated in FIG. 6 on the edge 12 of the air outlet 11 is connected to the center point 100 by a virtual line segment. Then, the area Q1 may be the area between this virtual line segment and a virtual line segment connecting between the center point 100 and the fifth point 105.

As is understood from the description of FIGS. 6 to 8, in the area P1 of FIG. 10, the inclination of the blown-out airflow from the propeller fan 1 with respect to the rotation axis 1*a* is smaller compared to that in the area Q1 of FIG. 10. In other words, in the area Q1 of FIG. 10, the inclination of the blown-out airflow from the propeller fan 1 with respect to the rotation axis 1*a* is larger compared to that in the area P1 of FIG. 10.

In consideration of this, in Embodiment 1, as illustrated in FIG. 11, the inclination angle 140 at the eighth point 108 present in the area P1 is set to be smaller than the inclination angle 140 at the ninth point 109 present in the area Q1. By setting the inclination angle 140 of the first crosspieces 21 in this manner, the inclination angle 140 can be reduced in the area P1 where the inclination of the blown-out airflow from the propeller fan 1 with respect to the rotation axis 1*a* is small. Meanwhile, the inclination angle 140 can be increased in the area Q1 where the inclination of the blown-out airflow from the propeller fan 1 with respect to the rotation axis 1*a* is large.

Thus, according to the air-sending device 40 of Embodiment 1, the airflow blown out from the propeller fan 1 can flow along the first crosspieces 21, in the area P1 and the area Q1 that differ in the inclination of the blown-out airflow from the propeller fan 1 with respect to the rotation axis 1*a*. Therefore, according to the air-sending device 40 of Embodiment 1, it is possible to reduce the ventilation resistance of the fan grille 20 as compared to the related art. Further, according to the air-sending device 40 of Embodiment 1, it is possible to prevent the airflow blown out from the propeller fan 1 from being directed away from the surface of the first crosspieces 21 as compared to the related art, and to reduce disturbance of airflow as compared to the related art. That is, according to the air-sending device 40 of Embodiment 1, it is possible to reduce noise and energy loss that occur when driving the air-sending device 40 as compared to the related art.

Note that in Embodiment 1, the inclination angle 140 at the portions of the plurality of first crosspieces 21 that are present in the area P1 is constant. Also, the inclination angle 140 at the portions of the plurality of first crosspieces 21 that are present in the area Q1 is constant.

Embodiment 1 aims to further reduce noise and energy loss that occur when driving the air-sending device 40. To this end, the inclination angle 140 at the portions of the plurality of first crosspieces 21 that are present in an area P2 illustrated in FIG. 10 and the inclination angle 140 at the portions of the plurality of first crosspieces 21 that are present in an area Q2 illustrated in FIG. 10 are set as described below. Note that the area P2 is an area defined by a virtual line segment connecting between the center point 100 and the fourth point 104, a portion between the fourth point 104 and the second point 102 in the varying portion 14 of the edge 12 of the air outlet 11, and a virtual line segment connecting between the center point 100 and the second point 102. Further, the area Q2 is an area defined by a virtual line segment connecting between the center point 100 and the second point 102, a portion between the second point 102 and the fifth point 105 in the varying portion 14 of the edge 12 of the air outlet 11, and a virtual line segment connecting between the center point 100 and the fifth point 105.

Figure 12:
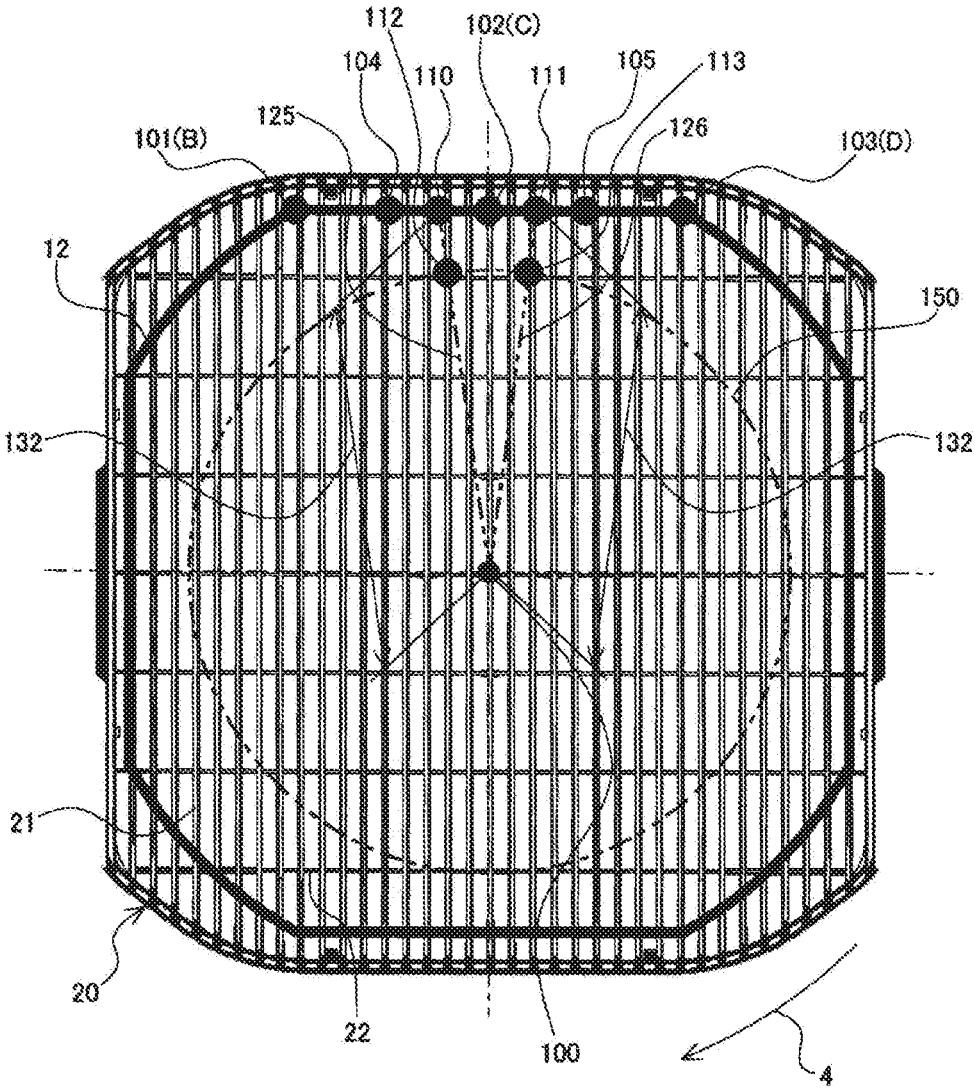
FIG. 12 illustrates the air-sending device according to Embodiment 1 of the present disclosure, wherein the rotation axis, the air outlet of the bell mouth, and the plurality of first crosspieces are projected on a virtual plane orthogonal to the rotation axis.

FIG. 12 illustrates the air-sending device according to Embodiment 1 of the present disclosure, wherein the rotation axis, the air outlet of the bell mouth, and a plurality of first crosspieces are projected on a virtual plane orthogonal to the rotation axis.

On the virtual plane illustrated in FIG. 12, a tenth point 110, a second radial distance 132, an eleventh point 111, a fifth virtual line segment 125, a sixth virtual line segment 126, a twelfth point 112, and a thirteenth point 113 are defined as follows.

The tenth point 110 is a point that is on the edge 12 of the air outlet 11, and that is located before the second point 102 and after the fourth point 104 in the rotation direction 4 of the propeller fan 1. The second radial distance 132 is the radial distance 130 between the center point 100 and the tenth point 110. The eleventh point 111 is a point that is on the edge 12 of the air outlet 11, and that is located before the fifth point 105 and after the second point 102 in the rotation direction 4 of the propeller fan 1, and the radial distance 130 is the second radial distance 132. The fifth virtual line segment 125 is a virtual line segment connecting between the center point 100 and the tenth point 110. The sixth virtual line segment 126 is a virtual line segment connecting between the center point 100 and the eleventh point 111. The twelfth point 112 is a point of intersection of the virtual circle 150 and the fifth virtual line segment 125, of the plurality of first crosspieces 21. The thirteenth point 113 is a point of intersection of the virtual circle 150 and the sixth virtual line segment 126, of the plurality of first crosspieces 21.

When the above definitions are applied, the twelfth point 112 of the plurality of first crosspieces 21 is any one point on the portions of the plurality of first crosspieces 21 that are present in the area P2 illustrated in FIG. 10. Further, the thirteenth point 113 of the plurality of first crosspieces 21 is a point on the portions of the plurality of first crosspieces 21 that are present in the area Q2 illustrated in FIG. 10, and satisfies the above definitions.

As is understood from the description of FIGS. 6 to 8, in the area P2 of FIG. 10, the inclination of the blown-out airflow from the propeller fan 1 with respect to the rotation axis 1*a* is smaller compared to that in the area Q2 of FIG. 10. In other words, in the area Q2 of FIG. 10, the inclination of the blown-out airflow from the propeller fan 1 with respect to the rotation axis 1*a* is larger compared to that in the area P2 of FIG. 10.

In consideration of this, in Embodiment 1, the inclination angle 140 at the twelfth point 112 present in the area P2 is set to be smaller than that at the thirteenth point 113 present in the area Q2. By setting the inclination angle 140 of the first crosspieces 21 in this manner, the inclination angle 140 can be reduced in the area P2 where the inclination of the blown-out airflow from the propeller fan 1 with respect to the rotation axis 1*a* is small. Meanwhile, the inclination angle 140 can be increased in the area Q2 where the inclination of the blown-out airflow from the propeller fan 1 with respect to the rotation axis 1*a* is large.

Thus, according to the air-sending device 40 of Embodiment 1, the airflow blown out from the propeller fan 1 can flow along the first crosspieces 21, in the area P2 and the area Q2 that differ in the inclination of the blown-out airflow from the propeller fan 1 with respect to the rotation axis 1*a* as well. Therefore, according to the air-sending device 40 of Embodiment 1, it is possible to further reduce the ventilation resistance of the fan grille 20. Further, according to the air-sending device 40 of Embodiment 1, it is possible to further prevent the airflow blown out from the propeller fan 1 from being directed away from the surface of the first crosspieces 21, and to further reduce disturbance of airflow. That is, according to the air-sending device 40 of Embodiment 1, it is possible to further reduce noise and energy loss that occur when driving the air-sending device 40.

Note that in Embodiment 1, the inclination angle 140 at the twelfth point 112 present in the area P2 is equal to the inclination angle 140 at the eighth point 108 present in the area P1. Further, the inclination angle 140 at the portions of the plurality of first crosspieces 21 that are present in the area P2 illustrated in FIG. 10 is constant. Further, the inclination angle 140 at the thirteenth point 113 present in the area Q2 is equal to the inclination angle 140 at the ninth point 109 present in the area Q1. Also, the inclination angle 140 at the portions of the plurality of first crosspieces 21 that are present in the area Q2 illustrated in FIG. 10 is constant.

Embodiment 1 does not particularly mention the configuration of the plurality of second crosspieces 22. The plurality of second crosspieces 22 may have the same configuration as the plurality of first crosspieces 21 described above. Thus, it is possible to further reduce the ventilation resistance and disturbance of airflow, and to further reduce noise and energy loss that occur when driving the air-sending device 40.

Embodiment 2

The shape of the air outlet 11 of the bell mouth 10 illustrated in Embodiment 1 is merely an example. By setting the inclination angle of the first crosspieces 21 as in Embodiment 1 for the air outlet 11 of the bell mouth 10 that is axially asymmetric with respect to the rotation axis 1*a* of the propeller fan 1, it is possible to reduce noise and energy loss that occur when driving the air-sending device 40 as compared to the related art. The air outlet 11 of the bell mouth 10 may have the following shape, for example. It should be noted that, in Embodiment 2, items not specifically described are the same as those of Embodiment 1, and the same functions and configurations as those of Embodiment 1 are denoted by the same reference signs.

Figure 13:
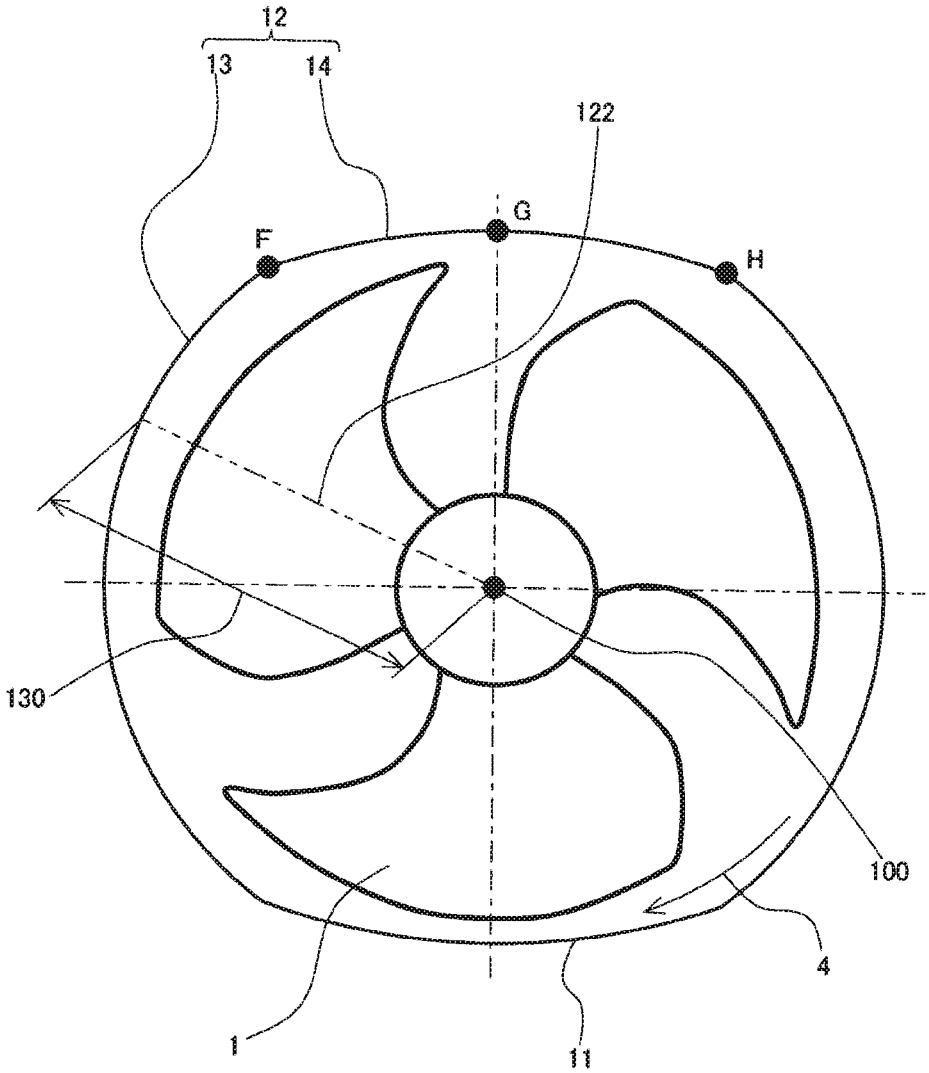
FIG. 13 illustrates an air-sending device according to Embodiment 2 of the present disclosure, wherein a rotation axis and an air outlet of a bell mouth are projected on a virtual plane orthogonal to the rotation axis.
Figure 14:
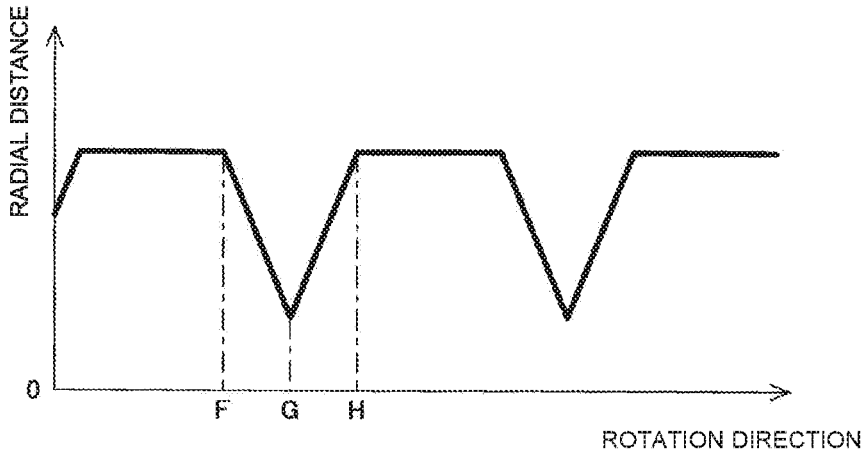
FIG. 14 is a view for explaining the distance between the rotation axis and the air outlet of the bell mouth, in the air-sending device according to Embodiment 2 of the present disclosure.
Figure 15:
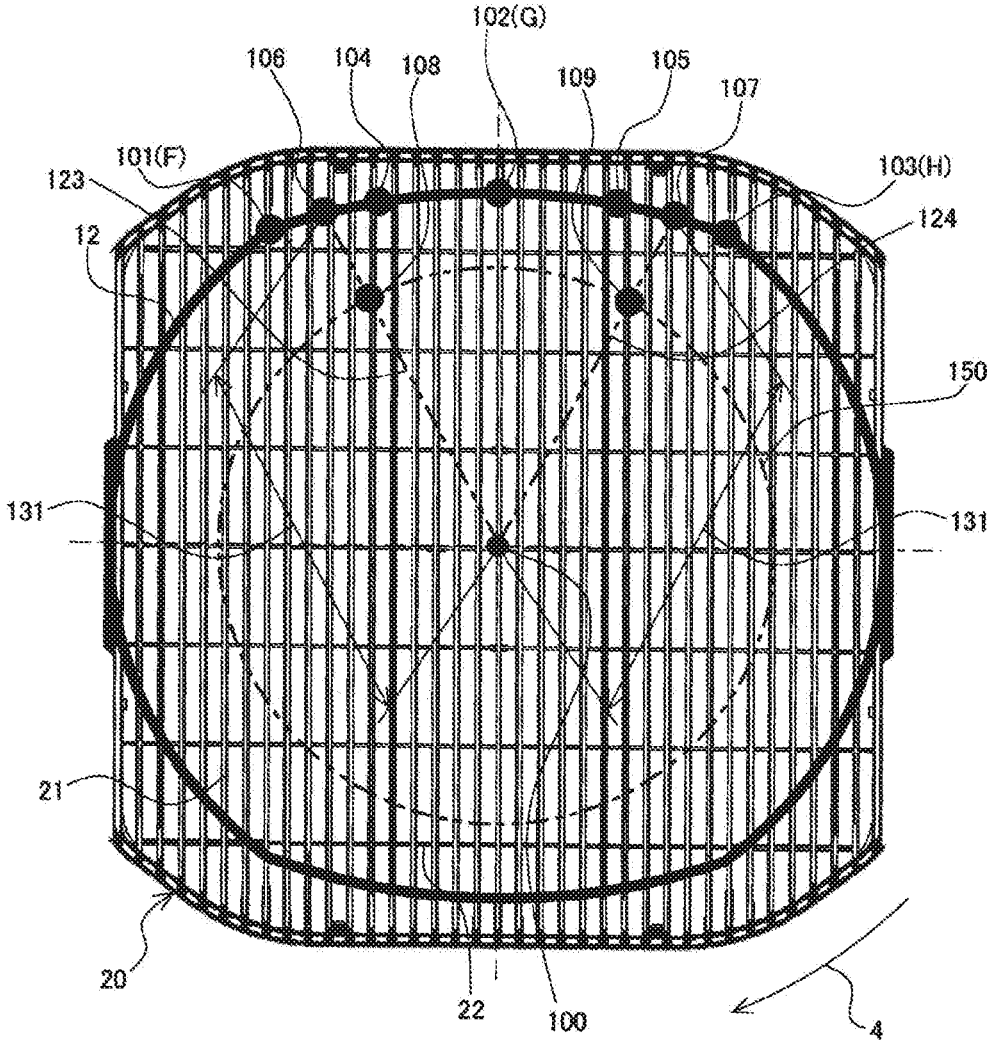
FIG. 15 illustrates the air-sending device according to Embodiment 2 of the present disclosure, wherein the rotation axis, the air outlet of the bell mouth, and a plurality of first crosspieces are projected on a virtual plane orthogonal to the rotation axis.

FIG. 13 illustrates an air-sending device according to Embodiment 2 of the present disclosure, wherein a rotation axis and an air outlet of a bell mouth are projected on a virtual plane orthogonal to the rotation axis. FIG. 14 is a view for explaining the distance between the rotation axis and the air outlet of the bell mouth, in the air-sending device according to Embodiment 2 of the present disclosure. FIG. 15 illustrates the air-sending device according to Embodiment 2 of the present disclosure, wherein the rotation axis, the air outlet of the bell mouth, and a plurality of first crosspieces are projected on a virtual plane orthogonal to the rotation axis.

The air-sending device 40 of Embodiment 2 is different from the air-sending device 40 of Embodiment 1 in the shape of the varying portion 14 of the edge 12 of the air outlet 11 of the bell mouth 10. In Embodiment 1, the varying portion 14 has a linear shape when the varying portion 14 is viewed in the direction of the rotation axis 1*a*. Meanwhile, in Embodiment 2, the varying portion 14 has a circular-arc shape when the varying portion 14 is viewed in the direction of the rotation axis 1*a*. Further, the curvature radius of the varying portion 14 of Embodiment 2 is greater than the curvature radius of the constant portion 13.

As illustrated in FIG. 14, in the air-sending device 40 of Embodiment 2 as well, when any one point on the edge 12 of the air outlet 11 as an end of the second virtual line segment moves in the rotation direction of the propeller fan 1, namely, the rotation direction 4, the radial distance 130 varies in the same manner as in Embodiment 1.

Specifically, as illustrated in FIG. 13, the varying portion 14 is the range from a point F to a point H. When the midpoint between the point F and the point H is defined as a point G, the radial distance 130 decreases in the range from the point F to the point G. That is, in the range from the point F to the point G, the distance from the rotation axis 1*a* of the propeller fan 1 decreases. Meanwhile, in the range from the point G to the point H, the radial distance 130 increases. That is, in the range from the point G to the point H, the distance from the rotation axis 1*a* of the propeller fan 1 increases.

Therefore, in the air-sending device 40 of Embodiment 2 as well, the airflow blown out from the propeller fan 1 varies in the same manner as in Embodiment 1, due to the influence of the varying portion 14. Accordingly, in the range from the point F to the point G where the radial distance 130 decreases, the component in the direction of the rotation axis 1*a* of the blown-out airflow from the propeller fan 1 becomes greater, so that the inclination of the airflow with respect to the rotation axis 1*a* is reduced. Meanwhile, in the range from the point G to the point H where the radial distance 130 increases, the inclination of the blown-out airflow from the propeller fan 1 with respect to the rotation axis 1*a* is increased.

Accordingly, as illustrated in FIG. 15, in the air-sending device 40 of Embodiment 2 as well, the eighth point 108 and the ninth point 109 are defined as in Embodiment 1. Note that in Embodiment 2, the first point 101 is, for example, the point F of FIG. 13. The second point 102 is, for example, the point G of FIG. 13. The third point is, for example, the point H of FIG. 13.

Further, in the air-sending device 40 of Embodiment 2 as well, the inclination angle 140 at the eighth point 108 is set to be smaller than the inclination angle 140 at the ninth point 109. By setting the inclination angle 140 of the first crosspieces 21 in this manner, the inclination angle 140 can be reduced in the area P1 where the inclination of the blown-out airflow from the propeller fan 1 with respect to the rotation axis 1*a* is small, as in Embodiment 1. Meanwhile, the inclination angle 140 can be increased in the area Q1 where the inclination of the blown-out airflow from the propeller fan 1 with respect to the rotation axis 1*a* is large. Note that in Embodiment 2, the inclination angle 140 at the portions of the plurality of first crosspieces 21 that are present in the area P1 is constant. Also, the inclination angle 140 at the portions of the plurality of first crosspieces 21 that are present in the area Q1 is constant.

Thus, according to the air-sending device 40 of Embodiment 2, the airflow blown out from the propeller fan 1 can flow along the first crosspieces 21, in the area P1 and the area Q1 that differ in the inclination of the blown-out airflow from the propeller fan 1 with respect to the rotation axis 1*a*, as in Embodiment 1. Therefore, according to the air-sending device 40 of Embodiment 2, it is possible to reduce the ventilation resistance of the fan grille 20 as compared to the related art, as in Embodiment 1. Further; according to the air-sending device 40 of Embodiment 2, it is possible to prevent the airflow blown out from the propeller fan 1 from being directed away from the surface of the first crosspieces 21 as compared to the related art, and to reduce disturbance of airflow as compared to the related art, as in Embodiment 1. That is, according to the air-sending device 40 of Embodiment 2, it is possible to reduce noise and energy loss that occur when driving the air-sending device 40 as compared to the related art, as in Embodiment 1.

Note that, as in Embodiment 1, the twelfth point 112 and the thirteenth point 113 may be defined, and the inclination angle 140 at the twelfth point 112 may be set to be smaller than that at the thirteenth point 113. Thus, the airflow blown out from the propeller fan 1 can flow along the first crosspieces 21, in the area P2 and the area Q2 that differ in the inclination of the blown-out airflow from the propeller fan 1 with respect to the rotation axis 1*a* as well. Accordingly, it is possible to further reduce noise and energy loss that occur when driving the air-sending device 40.

Embodiment 3

The inclination angle 140 may vary with the position, at the portions of the plurality of first crosspieces 21 that are present in the area P1 and the area P2. Also, the inclination angle 140 may vary with the position, at the portions of the plurality of first crosspieces 21 that are present in the area Q1 and the area Q2. It should be noted that, in Embodiment 3, items not specifically described are the same as those of Embodiment 1 or Embodiment 2, and the same functions and configurations as those of Embodiment 1 or Embodiment 2 are denoted by the same reference signs.

Figure 16:
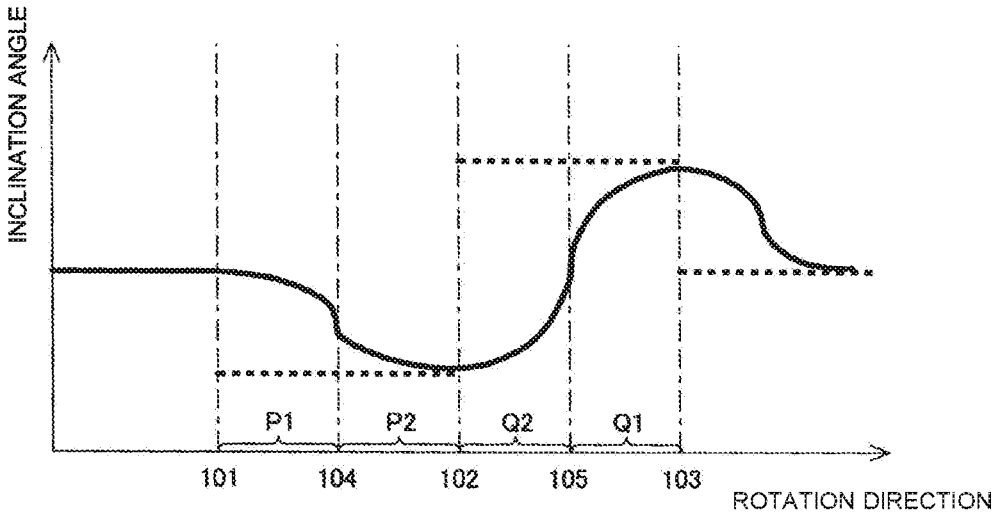
FIG. 16 illustrates an example of changes in the inclination angle, in an air-sending device according to Embodiment 3 of the present disclosure.

FIG. 16 illustrates an example of changes in the inclination angle, in an air-sending device according to Embodiment 3 of the present disclosure. The solid line illustrated in FIG. 16 indicates changes in the inclination angle 140 of the air-sending device 40 of Embodiment 3. The dashed line illustrated in FIG. 16 indicates changes in the inclination angle 140 of the air-sending device 40 of Embodiment 1.

As is clear from the dashed line from the first point 101 to the second point 102 in FIG. 16, in the air-sending device 40 of Embodiment 1, the inclination angle 140 is constant at the portions of the plurality of first crosspieces 21 that are present in the area P1 and the area P2. Also, as is clear from the dashed line from the second point 102 to the third point 103 in FIG. 16, in the air-sending device 40 of Embodiment 1, the inclination angle 140 is constant at the portions of the plurality of first crosspieces 21 that are present in the area Q1 and the area Q2.

Meanwhile, as is clear from the solid line from the first point 101 to the second point 102 in FIG. 16, in the air-sending device 40 of Embodiment 3, the inclination angle 140 varies at the portions of the plurality of first crosspieces 21 that are present in the area P1 and the area P2 when the inclination angle 140 is viewed in the rotation direction 4 of the propeller fan 1. Note that the way in which the inclination angle 140 increases and decreases in FIG. 16 is merely an example. Also, as is clear from the solid line from the second point 102 to the third point 103 in FIG. 16, in the air-sending device 40 of Embodiment 3, the inclination angle 140 varies at the portions of the plurality of first crosspieces 21 that are present in the area Q1 and the area Q2 when the inclination angle 140 is viewed in the rotation direction 4 of the propeller fan 1. Note that the way in which the inclination angle 140 increases and decreases in FIG. 16 is merely an example.

In the air-sending device 40 configured as in Embodiment 3 as well, by setting the inclination angle 140 at the eighth point 108 to be smaller than the inclination angle 140 at the ninth point 109, it is possible to reduce noise and energy loss that occur when driving the air-sending device 40, as compared to the related art. Also, in the air-sending device 40 configured as in Embodiment 3 as well, by setting the inclination angle 140 at the twelfth point 112 to be smaller than that at the thirteenth point 113, it is possible to further reduce noise and energy loss that occur when driving the air-sending device 40.

As described above, in the range where the side wall 15 becomes closer to the rotation axis 1*a* of the propeller fan 1 in the varying portion 14 of the edge 12 of the air outlet 11, the flow of the blown-out airflow from the propeller fan 1 is forced by the side wall 15, so that the inclination of the airflow with respect to the rotation axis 1*a* is reduced. Here, in the range where the side wall 15 becomes closer to the rotation axis 1*a* of the propeller fan 1 in the varying portion 14 of the edge 12 of the air outlet 11, the inclination of the blown-out airflow from the propeller fan 1 with respect to the rotation axis 1*a* is not uniform. The inclination of the blown-out airflow from the propeller fan 1 with respect to the rotation axis 1*a* varies with the shape of the varying portion 14 of the edge 12 of the air outlet 11. Further, as described above, in the range where the side wall 15 becomes farther from the rotation axis 1*a* of the propeller fan 1 in the varying portion 14 of the edge 12 of the air outlet 11, the inclination of the blown-out airflow from the propeller fan 1 with respect to the rotation axis 1*a* increases. In the range where the side wall 15 becomes farther from the rotation axis 1*a* of the propeller fan 1 in the varying portion 14 of the edge 12 of the air outlet 11 as well, the inclination of the blown-out airflow from the propeller fan 1 with respect to the rotation axis 1*a* varies with the shape of the varying portion 14 of the edge 12 of the air outlet 11.

In consideration of this, in the air-sending device 40 of Embodiment 3, the inclination angle 140 varies at the portions of the plurality of first crosspieces 21 that are present in the area P1 and the area P2 when the inclination angle 140 is viewed in the rotation direction of the propeller fan 1. Also, in the air-sending device 40 of Embodiment 3, the inclination angle 140 varies at the portions of the plurality of first crosspieces 21 that are present in the area Q1 and the area Q2 when the inclination angle 140 is viewed in the rotation direction of the propeller fan 1. With this configuration, the airflow blown out from the propeller fan 1 can flow further along the first crosspieces 21, so that it is possible to further reduce the ventilation resistance and disturbance of airflow. Accordingly, by configuring the air-sending device 40 as in Embodiment 3, it is possible to further reduce noise and energy loss that occur when driving the air-sending device 40.

Figure 17:
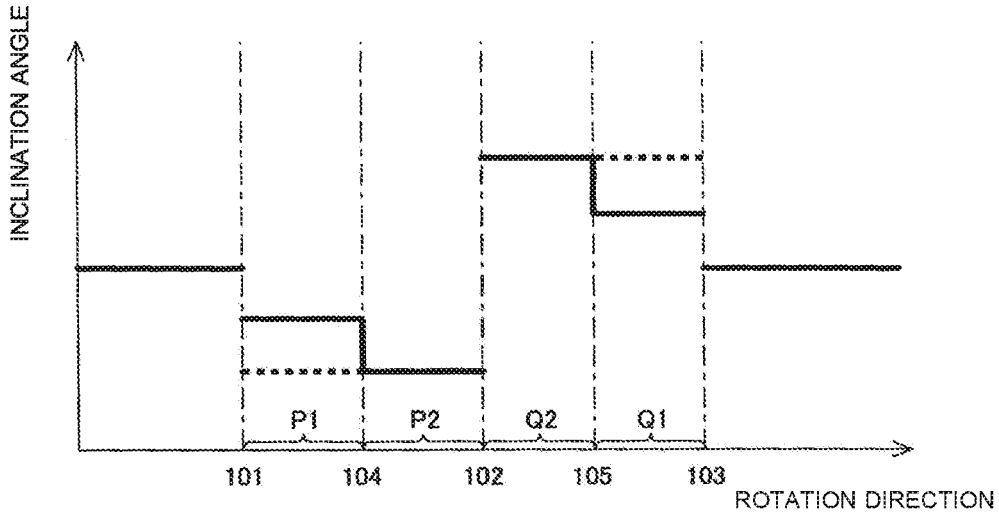
FIG. 17 illustrates another example of changes in the inclination angle, in the air-sending device according to Embodiment 3 of the present disclosure.

FIG. 17 illustrates another example of changes in the inclination angle, in an air-sending device according to Embodiment 3 of the present disclosure.

In FIG. 16, the inclination angle 140 at the portions of the plurality of first crosspieces 21 that are present in the area P1 and the area P2 varies gradually.

However, for example, as illustrated in FIG. 17, the inclination angle 140 at the portions of the plurality of first crosspieces 21 that are present in the area P1 and the area P2 may vary in a stepwise manner. Similarly, for example, as illustrated in FIG. 17, the inclination angle 140 at the portions of the plurality of first crosspieces 21 that are present in the area Q1 and the area Q2 may vary in a stepwise manner.

Embodiment 4

In the air-sending devices 40 of Embodiments 1 to 3, the inclination angle 140 of the first crosspieces 21 may be changed in accordance with the distance from the rotation axis 1*a*. Then, it is possible to further reduce noise and energy loss that occur when driving the air-sending device 40. It should be noted that, in Embodiment 4, items not specifically described are the same as those of any of Embodiments 1 to 3, and the same functions and configurations as those of any of Embodiments 1 to 3 are denoted by the same reference signs.

Figure 18:
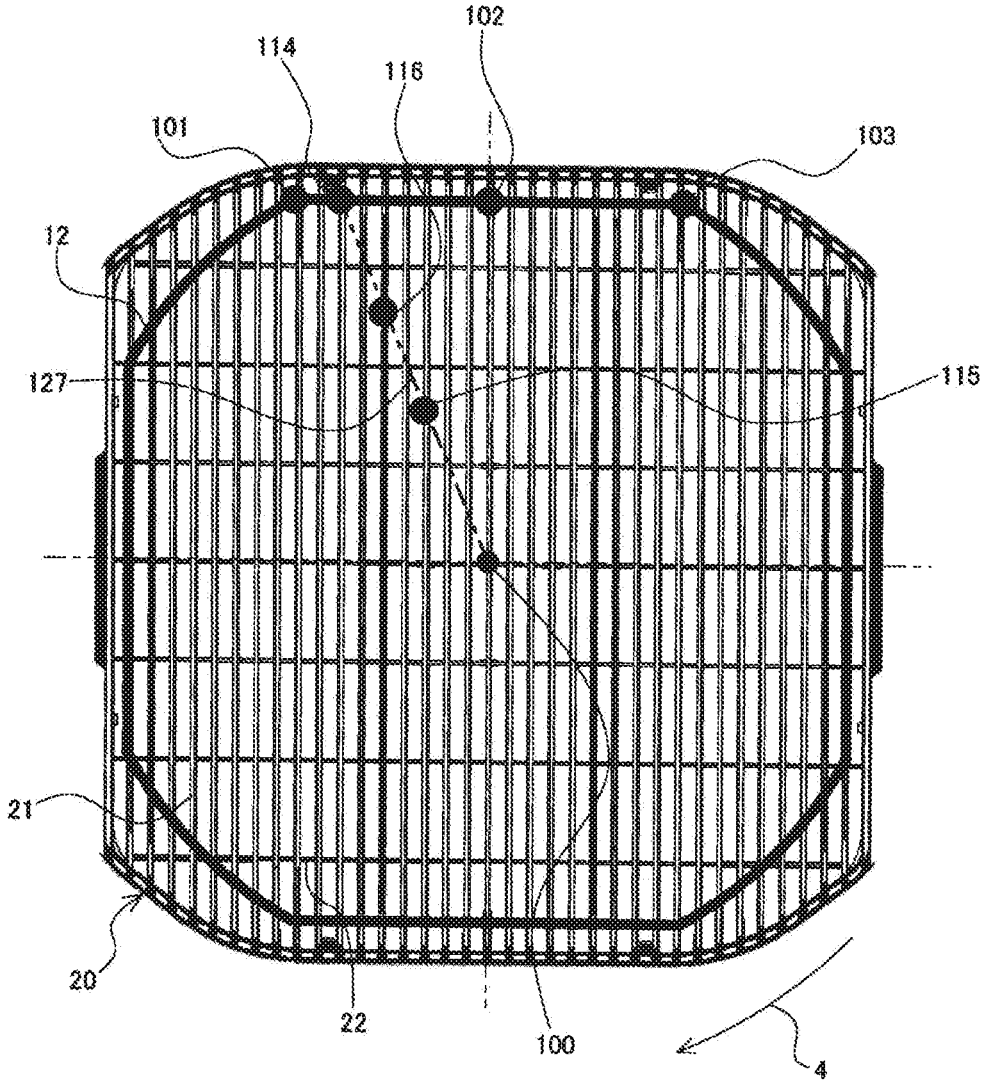
FIG. 18 illustrates an air-sending device according to Embodiment 4 of the present disclosure, wherein a rotation axis, an air outlet of a bell mouth, and a plurality of first crosspieces are projected on a virtual plane orthogonal to the rotation axis.
Figure 19:
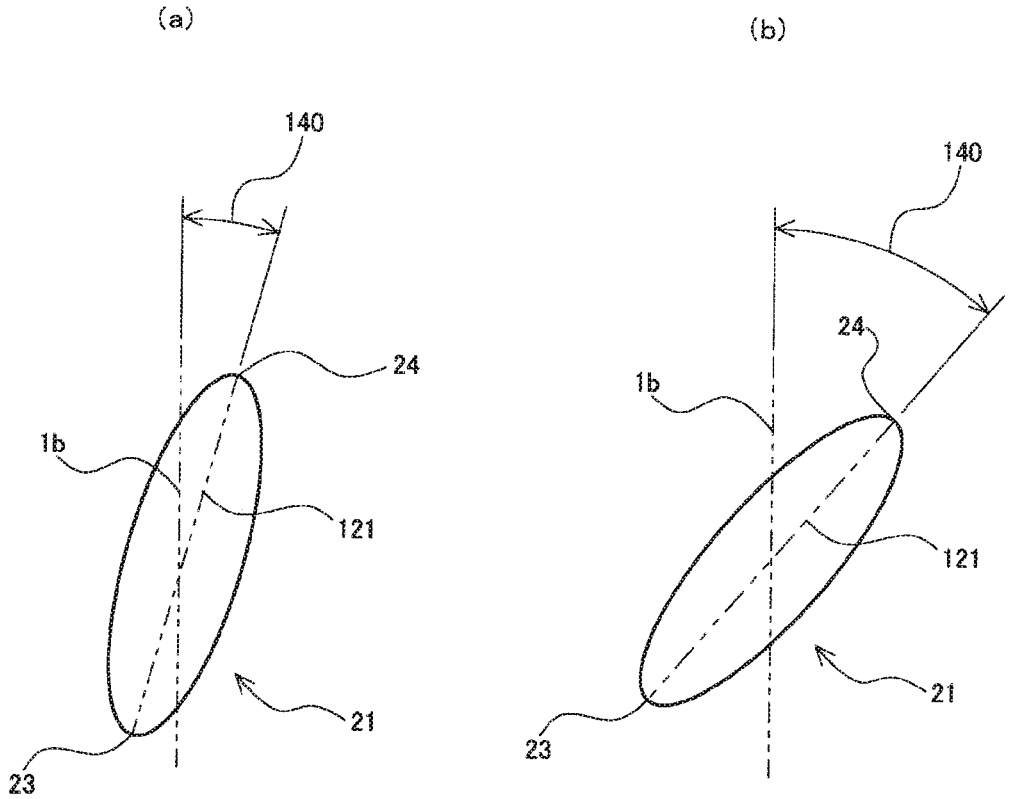
FIG. 19 is a cross-sectional view of the first crosspieces at a fifteenth point and a sixteenth point of FIG. 18, illustrating cross-sections of the first crosspieces perpendicular to the longitudinal direction of the first crosspieces at the fifteenth point and the sixteenth point.

FIG. 18 illustrates an air-sending device according to Embodiment 4 of the present disclosure, wherein a rotation axis, an air outlet of a bell mouth, and a plurality of first crosspieces are projected on a virtual plane orthogonal to the rotation axis. FIG. 19 is a cross-sectional view of the first crosspieces at a fifteenth point and a sixteenth point of FIG. 18, illustrating cross-sections of the first crosspieces perpendicular to the longitudinal direction of the first crosspieces at the fifteenth point and the sixteenth point. Note that FIG. 19(*a*) is a cross-sectional view of the first crosspiece 21 at the fifteenth point illustrated in FIG. 18. FIG. 19(*b*) is a cross-sectional view of the first crosspiece 21 at the sixteenth point illustrated in FIG. 18.

On the virtual plane illustrated in FIG. 18, a fourteenth point 114, a seventh virtual line segment 127, a fifteenth point 115, and a sixteenth point 116 are defined as follows. The fourteenth point 114 is a point that is on the edge 12 of the air outlet 11, and that is located before the third point 103 and after the first point 101 in the rotation direction 4 of the propeller fan 1. The seventh virtual line segment 127 is a virtual line segment connecting between the center point 100 and the fourteenth point 114. The fifteenth point 115 is any one point of intersection with the seventh virtual line segment 127 of the plurality of first crosspieces 21. The sixteenth point 116 is a point of intersection with the seventh virtual line segment 127 of the plurality of first crosspieces 21, at a position farther from the center point 100 than the fifteenth point 115.

When the above definitions are applied, in the air-sending device 40 of Embodiment 4, the inclination angle 140 at the sixteenth point 116 is larger than the inclination angle 140 at the fifteenth point 115, as illustrated in FIG. 19. That is, in the air-sending device 40 of Embodiment 4, the inclination angle 140 at a point of the plurality of first crosspieces 21 on a virtual line segment connecting between any point on the varying portion 14 of the edge 12 and the center point 100 is greater when the point is farther from the center point 100, that is, the rotation axis 1*a*.

The speed of the swirling flow blown out from the propeller fan 1 is higher when the distance from the rotation axis 1*a* is greater, Therefore, the inclination of the airflow blown out of the propeller fan 1 with respect to the rotation axis 1*a* is greater when the distance from the rotation axis 1*a* is greater. Accordingly, by setting the inclination angle 140 of the first crosspieces 21 as in Embodiment 4, it is possible to make the airflow blown out from the propeller fan 1 flow further along the first crosspieces 21, and to further reduce the ventilation resistance and disturbance of airflow. Accordingly, by configuring the air-sending device 40 as in Embodiment 4, it is possible to further reduce noise and energy loss that occur when driving the air-sending device 40.

Embodiment 5

It is possible to further reduce noise and energy loss that occur when driving the air-sending device 40, by adopting the configuration of the inclination angle 140 of the first crosspieces 21 illustrated in Embodiment 5 to the air-sending device 40 of any of Embodiments 1 to 4. It should be noted that, in Embodiment 5, items not specifically described are the same as those of any of Embodiments 1 to 4, and the same functions and configurations as those of any of Embodiments 1 to 4 are denoted by the same reference signs.

Figure 20:
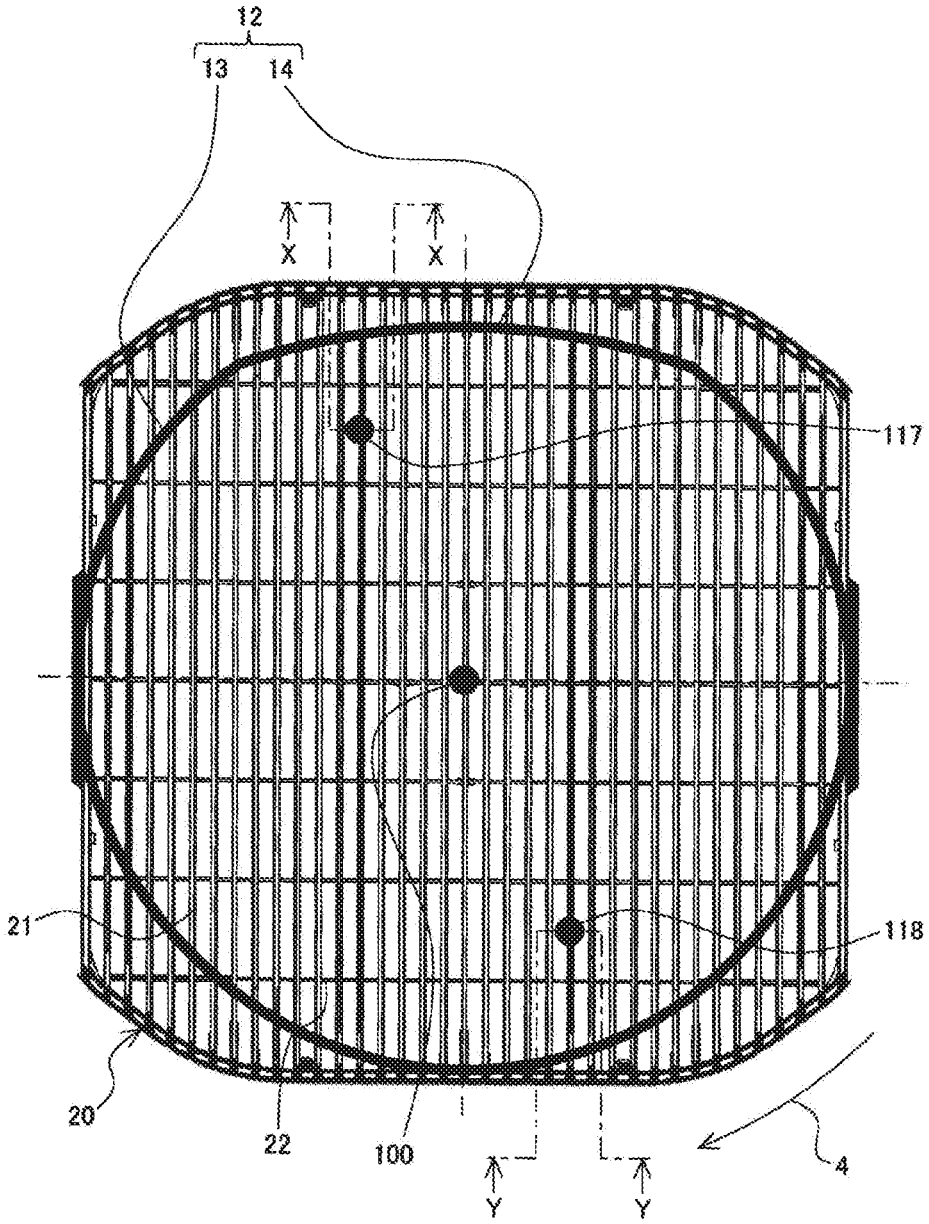
FIG. 20 illustrates an air-sending device according to Embodiment 5 of the present disclosure, wherein a rotation axis, an air outlet of a bell mouth, and a plurality of first crosspieces are projected on a virtual plane orthogonal to the rotation axis.
Figure 21:
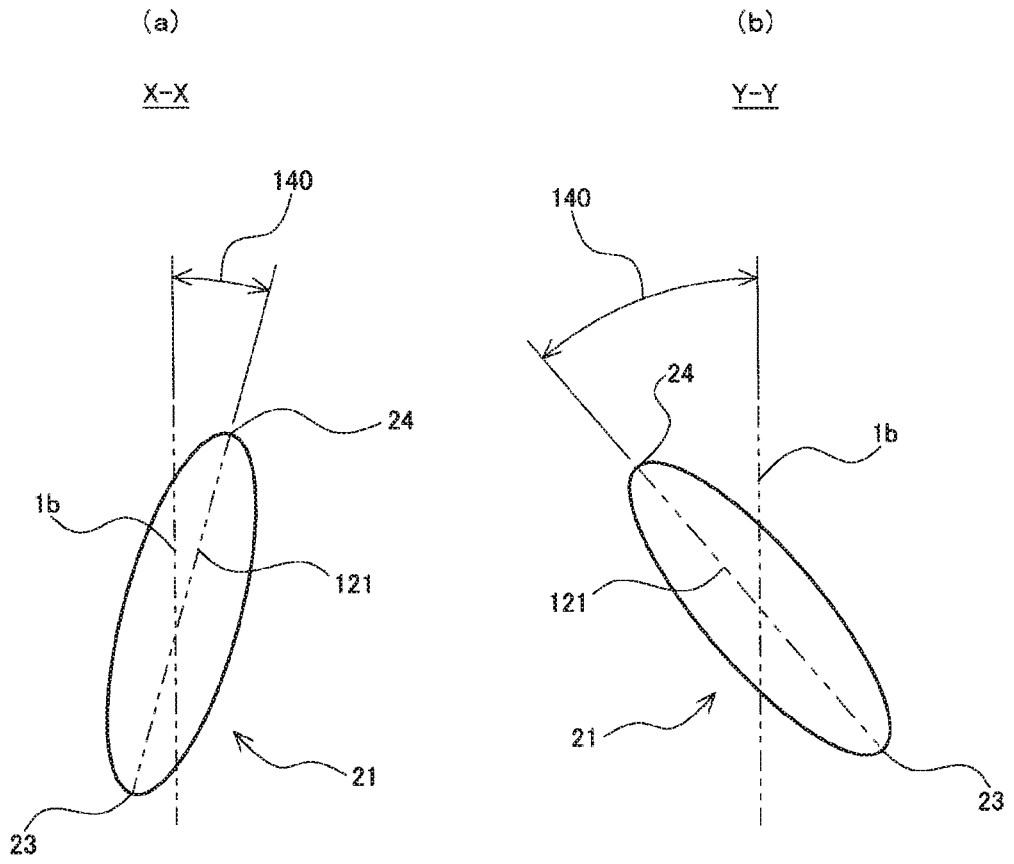
FIG. 21 is a cross-sectional view of the first crosspieces at a seventeenth point and an eighteenth point of FIG. 20, illustrating cross-sections of the first crosspieces perpendicular to the longitudinal direction of the first crosspieces at the seventeenth point and the eighteenth point.

FIG. 20 illustrates an air-sending device according to Embodiment 5 of the present disclosure, wherein a rotation axis, an air outlet of a bell mouth, and a plurality of first crosspieces are projected on a virtual plane orthogonal to the rotation axis. FIG. 21 is a cross-sectional view of the first crosspieces at a seventeenth point and an eighteenth point of FIG. 20, illustrating cross-sections of the first crosspieces perpendicular to the longitudinal direction of the first crosspieces at the seventeenth point and the eighteenth point. Note that FIG. 21(*a*) is a cross-sectional view of the first crosspiece 21 at the seventeenth point illustrated in FIG. 20. FIG. 21(*b*) is a cross-sectional view of the first crosspiece 21 at the eighteenth point illustrated in FIG. 20. FIGS. 21(*a*) and 21(*b*) illustrate the cross-sections of the first crosspieces 21 when viewed from the same direction. FIGS. 21(*a*) and 21(*b*) illustrate the cross-sections of the first crosspieces 21 when viewed from the lower side of the drawing. That is, FIG. 21(*a*) is an X-X cross-sectional view of FIG. 20. Further, FIG. 21(*b*) is a Y-Y cross-sectional view of FIG. 20.

On the virtual plane illustrated in FIG. 20, a seventeenth point 117 and an eighteenth point 118 are defined as follows. The seventeenth point 117 is any one point of the plurality of first crosspieces 21. The eighteenth point 118 is a point symmetric to the seventeenth point 117 with respect to a center of symmetry at the center point 100, of the plurality of first crosspieces 21.

When the above definitions are used, the inclination directions at the seventeenth point 117 and the eighteenth point 118 are opposite when the seventeenth point 117 and the eighteenth point 118 are viewed from the same direction.

As described above, the airflow blown out from the propeller fan 1 is a swirling flow. Therefore, when the blown-out airflows from the propeller fan 1 passing through two points symmetric with respect to the center point 100 are viewed from the same direction, the blown-out airflows from the propeller fan 1 are inclined in opposite directions with respect to the rotation axis 1*a*. Accordingly, by setting the inclination angle 140 of the first crosspieces 21 as in Embodiment 5, it is possible to make the airflow blown out from the propeller fan 1 flow further along the first crosspieces 21, and to further reduce the ventilation resistance and disturbance of airflow. Therefore, by configuring the air-sending device 40 as in Embodiment 5, it is possible to further reduce noise and energy loss that occur when driving the air-sending device 40.

Note that the inclination angle 140 at the seventeenth point 117 and the inclination angle 140 at the eighteenth point 118 do not have to be equal. The inclination angle 140 at the seventeenth point 117 may be appropriately determined in accordance with the inclination of the blown-out airflow from the propeller fan 1 with respect to the rotation axis 1*a* when passing through the seventeenth point 117. The inclination angle 140 at the eighteenth point 118 may be appropriately determined in accordance with the inclination of the blown-out airflow from the propeller fan 1 with respect to the rotation axis 1*a* when passing through the eighteenth point 118.

For example, at the seventeenth point 117 illustrated in FIG. 20, the blown-out airflow from the propeller fan 1 is affected by the varying portion 14 of the edge 12. Specifically, the flow of the blown-out airflow from the propeller fan 1 passing through the seventeenth point 117 is forced by the side wall 15, so that the inclination of the airflow with respect to the rotation axis 1*a* is smaller than the blown-out airflow from the propeller fan 1 passing through the eighteenth point 118. Meanwhile, at the eighteenth point 118 illustrated in FIG. 20, the blown-out airflow from the propeller fan 1 is not affected by the varying portion 14 of the edge 12. Therefore, the inclination of the blown-out airflow from the propeller fan 1 passing through the eighteenth point 118 with respect to the rotation axis 1*a* is smaller than the blown-out airflow from the propeller fan 1 passing through the seventeenth point 117. Accordingly, in FIG. 21, the inclination angle 140 at the seventeenth point 117 is smaller than the inclination angle 140 at the eighteenth point 118.

Embodiment 6

In the case where the fan grille 20 of any of Embodiments 1 to 5 is manufactured to have the configuration of Embodiment 6, another advantage is obtained in that the fan grille 20 is easily manufactured, in addition to the advantages of Embodiments 1 to 5. It should be noted that, in Embodiment 6, items not specifically described are the same as those of any of Embodiments 1 to 5, and the same functions and configurations as those of any of Embodiments 1 to 5 are denoted by the same reference signs.

Figure 22:
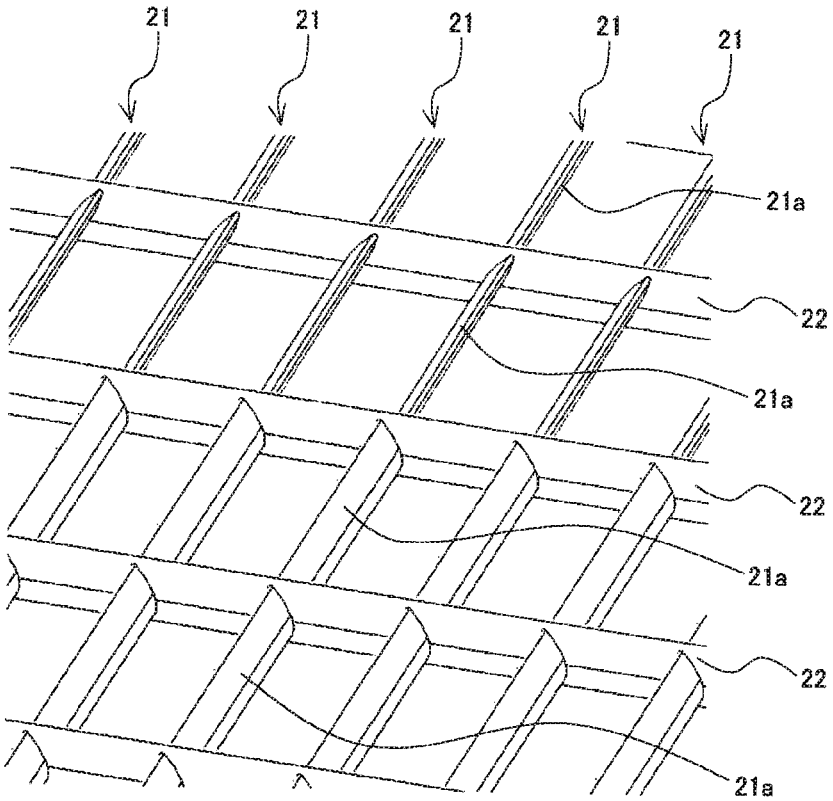
FIG. 22 is an enlarged perspective view illustrating a part of a fan grille of an air-sending device according to Embodiment 6 of the present disclosure.
Figure 23:
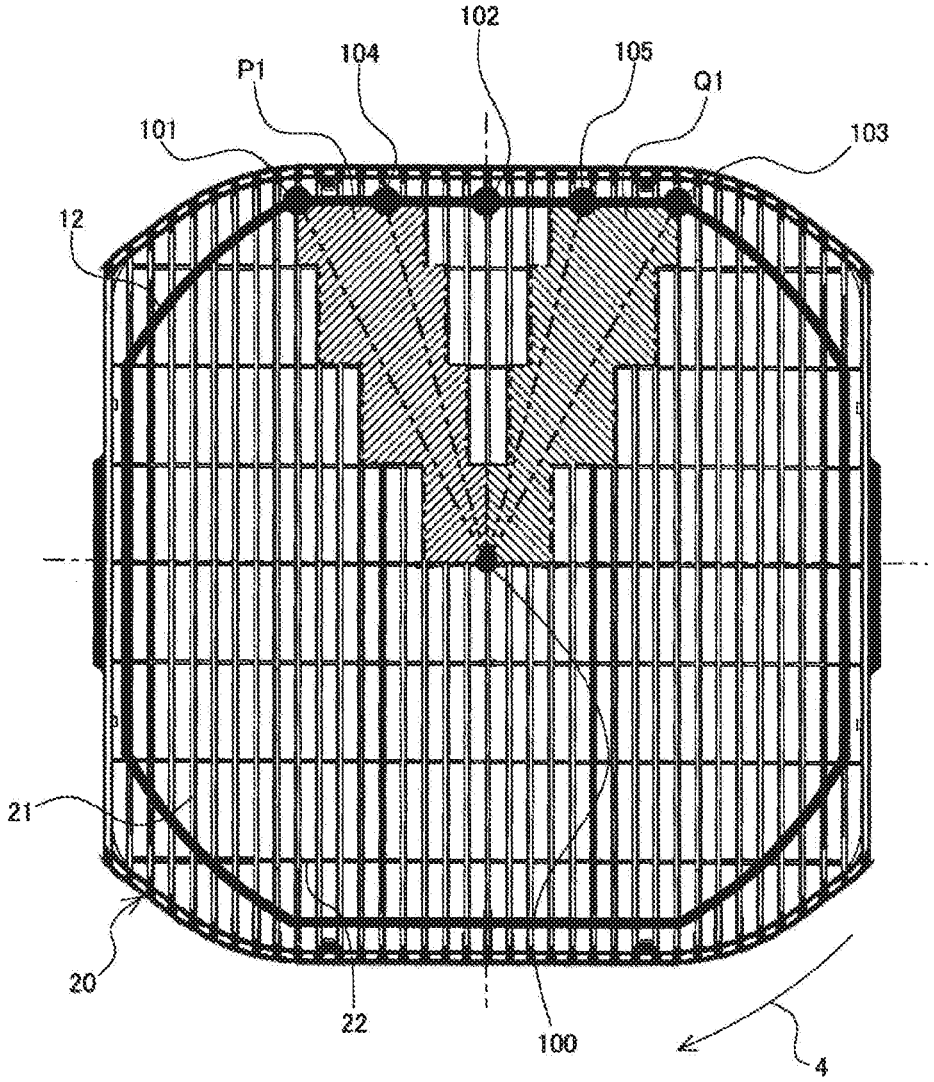
FIG. 23 illustrates the air-sending device according to Embodiment 6 of the present disclosure, wherein a rotation axis, an air outlet of a bell mouth, and the fan grille are projected on a virtual plane orthogonal to the rotation axis.

FIG. 22 is an enlarged perspective view illustrating a part of a fan grille of an air-sending device according to Embodiment 6 of the present disclosure. FIG. 23 illustrates the air-sending device according to Embodiment 6 of the present disclosure, wherein a rotation axis, an air outlet of a bell mouth, and the fan grille are projected on a virtual plane orthogonal to the rotation axis. FIG. 23 is a view for explaining the area P1 and the area Q1 in Embodiment 6.

In the fan grille 20 of the air-sending device 40 of Embodiment 6, the inclination angle 140 of any one of the plurality of first crosspieces 21 is constant between adjacent second crosspieces 22. Specifically, in FIG. 22, each of the first crosspieces 21 extends diagonally upward and rightward in the drawing. Referring to one of the first crosspieces 21, the first crosspiece 21 includes a plurality of crosspiece portions 21*a* that are divided at the positions of the second crosspieces 22. Further, referring to any one of the plurality of crosspiece portions 21*a*, the crosspiece portion 21*a* is configured such that the inclination angle 140 does not vary.

In the case of manufacturing the fan grille 20 of any of Embodiments 1 to 5, referring to each of the first crosspieces 21, the first crosspiece 21 is configured such that the inclination angle 140 varies with the position. In this case, in each of the first crosspieces 21 of Embodiment 6, the inclination angle 140 differs between the crosspiece portions 21*a* such that the inclination angle 140 is changed at intersections with the second crosspieces 22. Note that similar to each first crosspiece 21, each second crosspiece 22 of Embodiment 6 has an elongated shape in the cross-section perpendicular to the longitudinal direction. The inclination angle 140 of each second crosspiece 22 of Embodiment 6 is, for example, 0 degrees.

To make the inclination angle 140 vary with the position on each first crosspiece 21, the first crosspiece 21 may be twisted such that the inclination angle 140 varies continuously. However, this configuration makes it difficult to manufacture the fan grille 20. Specifically, the fan grille 20 is manufactured by, for example, injection molding of resin. Thus, in the case of the configuration in which the first crosspiece 21 is twisted such that the inclination angle 140 varies continuously, the structure of a mold portion that molds the first crosspiece 21 becomes complex.

Also, to make the inclination angle 140 vary with the position on each first crosspiece 21, the first crosspiece 21 may include the plurality of crosspiece portions 21*a* as in Embodiment 6 such that the inclination angle 140 differs between the crosspiece portions 21*a*. In this case, if the inclination angle 140 is changed at positions other than the intersections with the second crosspieces 22, the ends of the adjacent crosspiece portions 21*a* need to be directly connected to each other. However, if the ends of the adjacent crosspiece portions 21*a* are directly connected to each other, the area of the connection portion is reduced. Therefore, if the ends of the adjacent crosspiece portions 21*a* are directly connected to each other, the function of preventing foreign matter from entering from the outside may be impaired due to insufficient strength at the connection portion.

In the fan grille 20 of Embodiment 6, each end of each crosspiece portion 21*a* is connected to a side surface of one of the second crosspieces 22. Therefore, in the fan grille 20 of Embodiment 6, the area of each connection portion is increased. For example, the entire surface of the crosspiece portion 21*a* is connected to the side surface of the second crosspiece 22. Therefore, in the fan grille 20 of Embodiment 6, the strength of each connection portion is prevented from being insufficient. Further, in the fan grille 20 of Embodiment 6, referring to any one of the plurality of crosspiece portions 21*a*, the inclination angle 140 of the crosspiece portion 21*a* does not vary. Therefore, the structure of a mold portion that molds the crosspiece portion 21*a* does not become complex. Accordingly, when the fan grille 20 is configured as in Embodiment 6, the fan grille 20 is easily manufactured.

In the case where the fan grille 20 is configured as in Embodiment 6, if there is no connection portion between the first crosspiece 21 and the second crosspiece 22 on the virtual line segment connecting between the center point 100 and the first point 101, it is not possible to change the inclination angle 140 on the virtual line segment. Also, in the case where the fan grille 20 is configured as in Embodiment 6, if there is no connection portion between the first crosspiece 21 and the second crosspiece 22 on the virtual line segment connecting between the center point 100 and the fourth point 104, it is not possible to change the inclination angle 140 on the virtual line segment.

Therefore, in the case where the fan grille 20 is configured as in Embodiment 6, it is not possible to define the area P1 in the manner illustrated in FIG. 10. Accordingly, in the case where the fan grille 20 is configured as in Embodiment 6, the area P1 may be defined in a stepped shape in accordance with the positions of the second crosspieces 22 as illustrated in FIG. 23. The area P1 defined in a stepped shape has only to include the area P1 illustrated in FIG. 10.

Likewise, in the case where the fan grille 20 is configured as in Embodiment 6, if there is no connection portion between the first crosspiece 21 and the second crosspiece 22 on the virtual line segment connecting between the center point 100 and the third point 103, it is not possible to change the inclination angle 140 on the virtual line segment. Also, in the case where the fan grille 20 is configured as in Embodiment 6, if there is no connection portion between the first crosspiece 21 and the second crosspiece 22 on the virtual line segment connecting between the center point 100 and the fifth point 105, it is not possible to change the inclination angle 140 on the virtual line segment. Therefore, in the case where the fan grille 20 is configured as in Embodiment 6, it is not possible to define the area Q1 in the manner illustrated in FIG. 10. Accordingly, in the case where the fan grille 20 is configured as in Embodiment 6, the area Q1 may be defined in a stepped shape in accordance with the positions of the second crosspieces 22 as illustrated in FIG. 23. The area Q1 defined in a stepped shape has only to include the area Q1 illustrated in FIG. 10.

Note that in the case where each second crosspiece 22 has an elongated shape in the cross-section perpendicular to the longitudinal direction, each second crosspiece 22 of Embodiment 6 is preferably configured such that the inclination angle 140 does not vary with the position on the second crosspiece 22, in view of the easiness of manufacturing the fan grille 20.

Embodiment 7

A refrigeration cycle apparatus includes an air-sending device, and a heat exchanger configured to exchange heat between the refrigerant flowing inside and the air supplied by the air-sending device. The air-sending device 40 of any of Embodiments 1 to 6 may be used as an air-sending device for such a refrigeration cycle apparatus other than an air-conditioning apparatus, for example. The following describes an example in which the air-sending device 40 of any of Embodiments 1 to 6 is used in an air-conditioning apparatus as an example of a refrigeration cycle apparatus. More specifically, in the following example in which the air-sending device 40 is used in a refrigeration cycle apparatus, the air-sending device 40 is used as an air-sending device for an outdoor unit of an air-conditioning apparatus. It should be noted that, in Embodiment 7, items not specifically described are the same as those of any of Embodiments 1 to 6, and the same functions and configurations as those of any of Embodiments 1 to 6 are denoted by the same reference signs.

Figure 24:
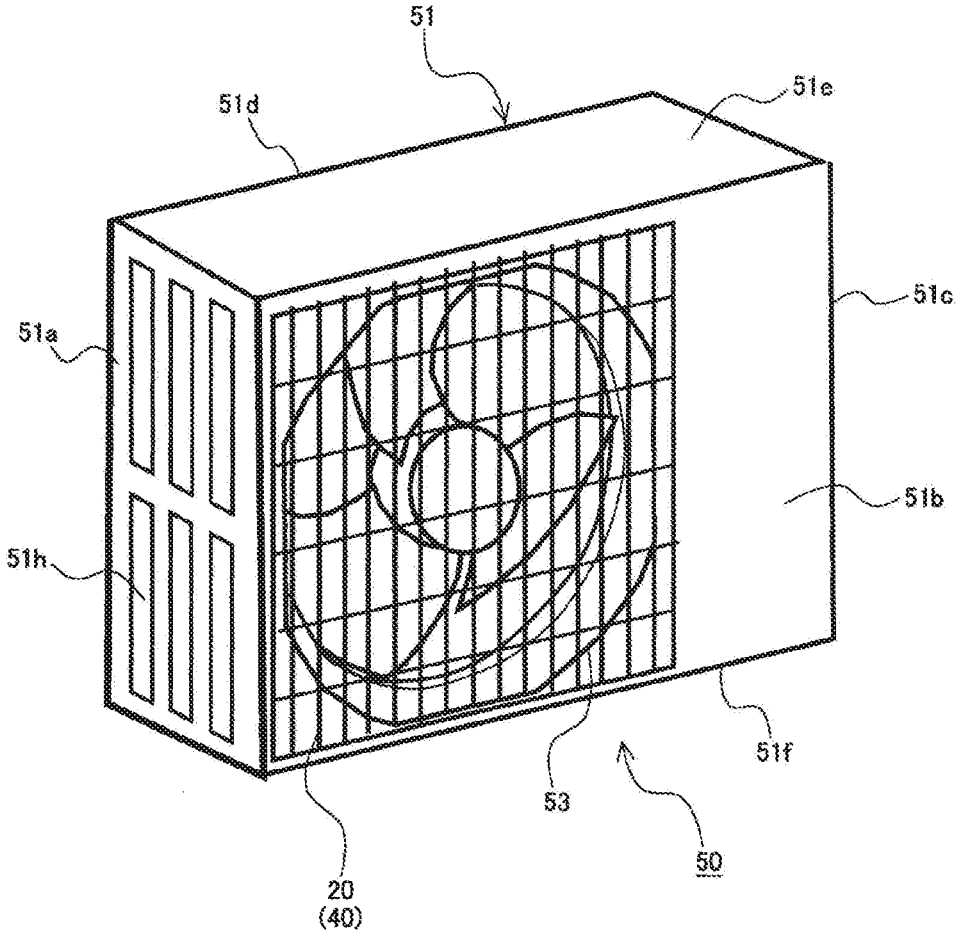
FIG. 24 is a perspective view of an outdoor unit of an air-conditioning apparatus according to Embodiment 7 of the present disclosure, as viewed from an air outlet.
Figure 25:
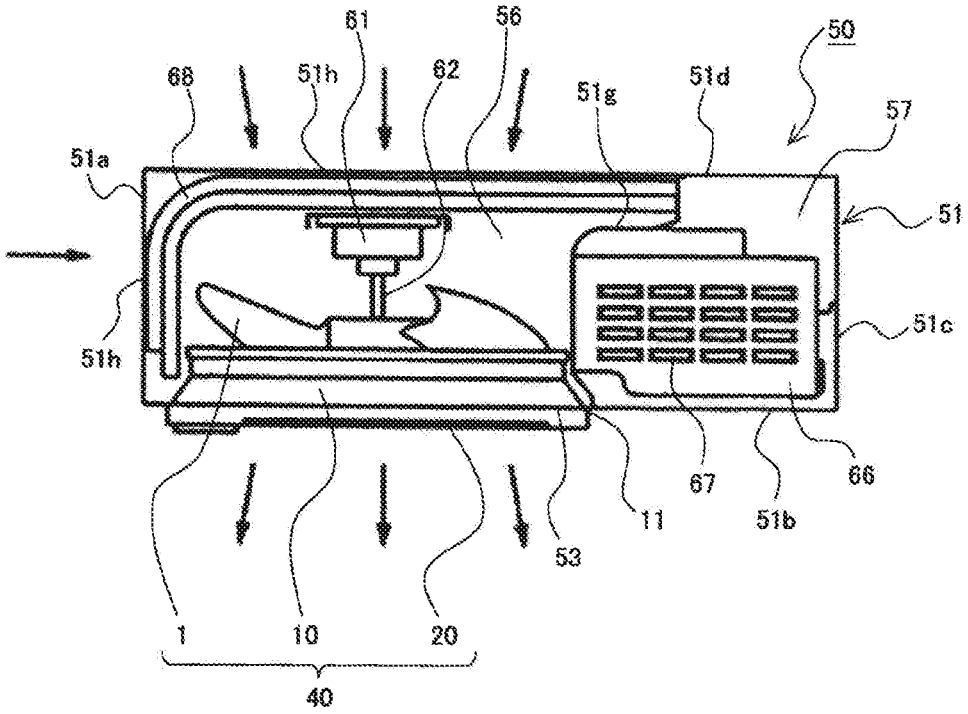
FIG. 25 illustrates the internal configuration of the outdoor unit of the air-conditioning apparatus according to Embodiment 7 of the present disclosure as viewed from the above.
Figure 26:
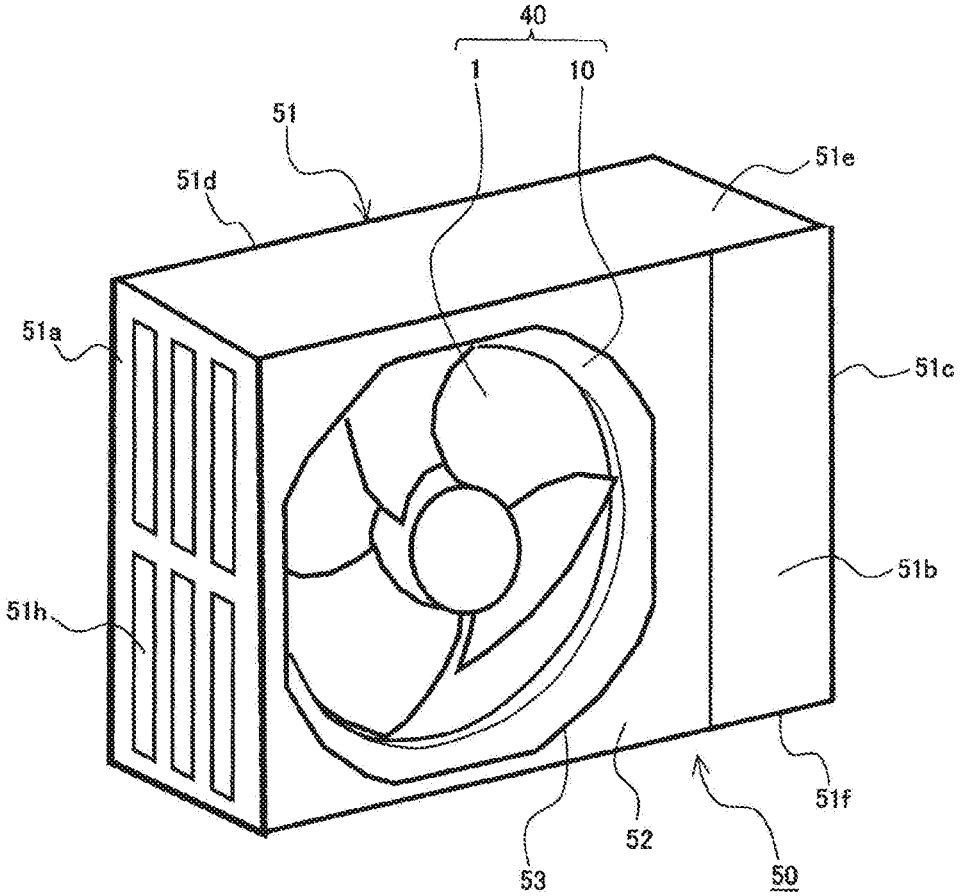
FIG. 26 is a perspective view illustrating the outdoor unit of the air-conditioning apparatus, with a fan grille removed, according to Embodiment 7 of the present disclosure, as viewed from the air outlet.
Figure 27:
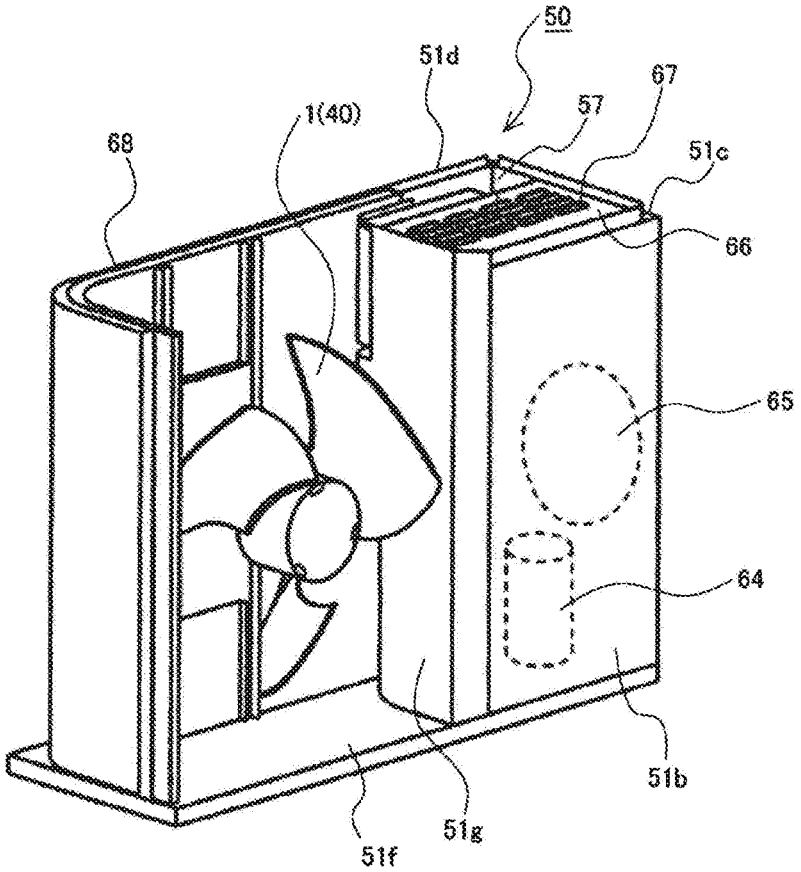
FIG. 27 is a perspective view illustrating the internal configuration of the outdoor unit of the air-conditioning apparatus according to Embodiment 7 of the present disclosure.

FIG. 24 is a perspective view of an outdoor unit of an air-conditioning apparatus according to Embodiment 7 of the present disclosure, as viewed from an air outlet. FIG. 25 illustrates the internal configuration of the outdoor unit of the air-conditioning apparatus according to Embodiment 7 of the present disclosure as viewed from the above. FIG. 26 is a perspective view illustrating the outdoor unit of the air-conditioning apparatus, with a fan grille removed, according to Embodiment 7 of the present disclosure, as viewed from the air outlet. FIG. 27 is a perspective view illustrating the internal configuration of the outdoor unit of the air-conditioning apparatus according to Embodiment 7 of the present disclosure. Note that the straight arrows in FIG. 25 indicate the flow of air around an outdoor unit 50.

The outdoor unit 50 of the air-conditioning apparatus includes an outdoor unit main body 51 serving as a casing. The outdoor unit main body 51 includes a side surface 51*a*, a side surface 51*c*, a front surface 51*b*, a rear surface 51*d*, a top surface 51*e*, and a bottom surface 51*f*. The side surface 51*a* and the rear surface 51*d* have air inlets 51*h* for introducing air from the outside into the outdoor unit main body 51. The front surface 51*b* has an air outlet 53 for blowing out air from the inside of the outdoor unit main body 51 to the outside, in a front panel 52 forming a part of the front surface 51*b*.

The inside of the outdoor unit main body 51 is divided into an air-sending chamber 56 and a machine chamber 57 by a partition plate 51*g*. The air-sending chamber 56 accommodates the propeller fan 1 and the bell mouth 10 of the air-sending device 40 of any of Embodiments 1 to 6. The propeller fan 1 of the air-sending device 40 is connected to a fan motor 61 disposed on the rear surface 51*d* side via a shaft portion 62, and is rotated by the fan motor 61.

The air outlet 11 of the bell mouth 10 of the air-sending device 40 is connected to the front panel 52 of the outdoor unit to surround the outer periphery of the air outlet 53. Note that the bell mouth 10 may be formed integrally with the front panel 52, or may be formed separately from the front panel 52. The air passage near the air outlet 53 is separated from the other space inside the air-sending chamber 56 by the bell mouth 10.

As described above, the air-sending device 40 includes the fan grille 20 at the position downstream of the air outlet 11 of the bell mouth 10 in the direction of airflow generated by the propeller fan 1. In the outdoor unit 50 of Embodiment 7, the fan grille 20 is disposed on the front panel 52. Then, the front panel 52 is configured to cover the propeller fan 1 of the air-sending device 40 and the air outlet 11 of the bell mouth 10, and also cover the air outlet 53 formed in the front panel 52, while allowing ventilation. This prevents objects from coming into contact with the propeller fan 1, thereby ensuring safety.

The air-sending chamber 56 accommodates a heat exchanger 68. The heat exchanger 68 has a substantially L-shape in plan view, and is disposed to face the air inlets 51*h* formed in the side surface 51*a* and the rear surface 51*d*. The heat exchanger 68 is configured to exchange heat between the refrigerant flowing inside and the air supplied by the air-sending device 40. In Embodiment 7, the heat exchanger 68 is a fin-and-tube heat exchanger. That is, the heat exchanger 68 includes a plurality of fins arranged at predetermined intervals, and a plurality of heat transfer pipes extending through the fins in the arrangement direction of the fins. Refrigerant circulating in a refrigerant circuit flows through each heat transfer pipe.

The machine chamber 57 accommodates a compressor 64. The compressor 64 is connected to the heat exchanger 68 via a pipe 65 and other components. The compressor 64 and the heat exchanger 68 are connected to an indoor heat exchanger, an expansion valve, and other components (not illustrated) to form a refrigerant circuit. The machine chamber 57 accommodates a board box 66. A control board 67 disposed in the board box 66 controls the devices such as the fan motor 61 and the compressor 64 mounted on the outdoor unit 50.

The outdoor unit 50 of the air-conditioning apparatus of Embodiment 7 includes the air-sending device 40 of any of Embodiments 1 to 6 that reduces noise and energy loss as compared to the related art. Therefore, the outdoor unit 50 of the air-conditioning apparatus of Embodiment 7 achieves low noise and low energy loss.

The air-sending device 40 of any of Embodiments 1 to 6 may be used in a refrigeration cycle apparatus other than an air-conditioning apparatus. For example, a water heater as an example of a refrigeration cycle apparatus includes a heat exchanger disposed in an outdoor unit and configured to exchange heat between the refrigerant flowing inside and the air supplied by an air-sending device. Accordingly, the air-sending device 40 of any of Embodiments 1 to 6 may be used in the outdoor unit of the water heater.

REFERENCE SIGNS LIST

1 propeller fan 1*a* rotation axis 1*b* virtual line segment 2 boss 3 blade 4 rotation direction 5 leading edge 6 trailing edge 7 outer peripheral edge 8 airflow 10 bell mouth 11 air outlet 12 edge 13 constant portion 14 varying portion 15 side wall 20 fan grille 21 first crosspiece 21*a* crosspiece portion 22 second crosspiece 23 upstream side end portion 24 downstream side end portion 40 air-sending device 50 outdoor unit 51 outdoor unit main body 51*a* side surface 51*b* front surface 51*c* side surface 51*d* rear surface 51*e* top surface 51*f* bottom surface 51*g* partition plate 51*h* air inlet 52 front panel 53 air outlet 56 air-sending chamber 57 machine chamber 61 fan motor 62 shaft portion 64 compressor 65 pipe 66 board box 67 control board 68 heat exchanger 90 airflow 91 airflow 92 airflow 100 center point 101 first point 102 second point 103 third point 104 fourth point 105 fifth point 106 sixth point 107 seventh point 108 eighth point 109 ninth point 110 tenth point 111 eleventh point 112 twelfth point 113 thirteenth point 114 fourteenth point 115 fifteenth point 116 sixteenth point 117 seventeenth point 118 eighteenth point 121 first virtual line segment 122 second virtual line segment 123 third virtual line segment 124 fourth virtual line segment 125 fifth virtual line segment 126 sixth virtual line segment 127 seventh virtual line segment 130 radial distance 131 first radial distance 132 second radial distance 140 inclination angle 150 virtual circle

The invention claimed is:

1. An air-sending device comprising:

a propeller fan configured to rotate about a rotation axis;

a bell mouth having an air outlet and surrounding an outer periphery of the propeller fan; and a fan grille disposed downstream of the air outlet in a direction of airflow generated by the propeller fan, the fan grille including a plurality of first crosspieces;

each of the plurality of first crosspieces having an upstream side end portion and a downstream side end portion, the upstream side end portion being positioned on an upstream side of the airflow, the downstream side end portion being positioned on a downstream side of the airflow, wherein the air-sending device is configured such that where in a cross-section of any of the plurality of first crosspieces, the cross-section being perpendicular to a longitudinal direction of the any of the plurality of first crosspieces, a virtual line segment connecting the upstream side end portion and the downstream side end portion is a first virtual line segment, an acute angle of angles formed by the first virtual line segment and a virtual line segment extending in parallel to the rotation axis, the acute angle being formed on a side of the downstream side end portion, is an inclination angle, and on a virtual plane that is orthogonal to the rotation axis and on which the rotation axis, the air outlet and the plurality of first crosspieces are projected, a position of the rotation axis on the virtual plane is a center point, a virtual line segment connecting between the center point and any one point of an edge of the air outlet is a second virtual line segment, a length of the second virtual line segment is a radial distance, a first point is a point on the edge of the air outlet, from which the radial distance decreases when the second virtual line segment rotates about the center point in a rotation direction of the propeller fan, a second point is a point on the edge of the air outlet, from which the radial distance increases when the second virtual line segment rotates about the center point in the rotation direction past the first point, a third point is a point on the edge of the air outlet, from which the radial distance no longer increases when the second virtual line segment rotates about the center point in the rotation direction past the second point, a fourth point is a point on the edge of the air outlet, located before the second point and after the first point in the rotation direction, and being a midpoint between the first point and the second point, a fifth point is a point on the edge of the air outlet, located before the third point and after the second point in the rotation direction, and being a midpoint between the second point and the third point, a sixth point is a point on the edge of the air outlet, located before the fourth point and after the first point in the rotation direction, and the radial distance between the center point and the sixth point is a first radial distance, a seventh point is a point on the edge of the air outlet, located before the third point and after the fifth point in the rotation direction, and the radial distance between the center point and the seventh point is the first radial distance, a virtual line segment connecting between the center point and the sixth point is a third virtual line segment, a virtual line segment connecting between the center point and the seventh point is a fourth virtual line segment, an eighth point is a point of intersection of a virtual circle having a center being the center point and the third virtual line segment of the plurality of first crosspieces, a ninth point is a point of intersection of the virtual circle and the fourth virtual line segment of the plurality of first crosspieces, and the cross-section at the eighth point and the ninth point has a shape in which a dimension in a first direction from the upstream side end portion to the downstream side end portion is larger than a dimension in a second direction perpendicular to the first direction of the cross-section of the first crosspiece, and the inclination angle at the eighth point is smaller than the inclination angle at the ninth point.

2. The air-sending device of claim 1, wherein, where on the virtual plane, a tenth point is a point on the edge of the air outlet, located before the second point and after the fourth point in the rotation direction, and the radial distance between the center point and the tenth point is a second radial distance, an eleventh point is a point on the edge of the air outlet, located before the fifth point and after the second point in the rotation direction, and the radial distance between the center point and the eleventh point is the second radial distance, a virtual line segment connecting between the center point and the tenth point is a fifth virtual line segment, a virtual line segment connecting between the center point and the eleventh point is a sixth virtual line segment, a twelfth point is a point of intersection of the virtual circle and the fifth virtual line segment of the plurality of first crosspieces, and a thirteenth point is a point of intersection of the virtual circle and the sixth virtual line segment of the plurality of first crosspieces, the cross-section at the twelfth point and the thirteenth point has a shape in which the dimension in the first direction is larger than the dimension in the second direction, and the inclination angle at the twelfth point is smaller than the inclination angle at the thirteenth point.

3. The air-sending device of claim 1, wherein, where on the virtual plane, a fourteenth point is a point on the edge of the air outlet, located before the third point and after the first point in the rotation direction, a virtual line segment connecting between the center point and the fourteenth point is a seventh virtual line segment, a fifteenth point is any one point of intersection with the seventh virtual line segment of the plurality of first crosspieces, and a sixteenth point is a point of intersection with the seventh virtual line segment of the plurality of first crosspieces, at a position farther from the center point than the fifteenth point, the cross-section at the fifteenth point and the sixteenth point has a shape in which the dimension in the first direction is larger than the dimension in the second direction, and the inclination angle at the sixteenth point is larger than the inclination angle at the fifteenth point.

4. The air-sending device of claim 1, wherein, where on the virtual plane, a seventeenth point is any one point of the plurality of first crosspieces, and an eighteenth point is a point symmetric to the seventeenth point with respect to a center of symmetry being the center point, of the plurality of first crosspieces, when the seventeenth point and the eighteenth point are viewed from a same direction, inclination directions at the seventeenth point and the eighteenth point are opposite.

5. The air-sending device of claim 1, wherein the fan grille includes a plurality of second crosspieces each intersecting the first crosspieces; and wherein the inclination angle of any one of the plurality of first crosspieces is constant between adjacent two of the second crosspieces.

6. A refrigeration cycle apparatus comprising:

the air-sending device of claim 1; and a heat exchanger configured to exchange heat between refrigerant flowing inside and air supplied by the air-sending device.

* * * * *